US007750222B2

(12) United States Patent
Osuga

(10) Patent No.: US 7,750,222 B2
(45) Date of Patent: Jul. 6, 2010

(54) KEYBOARD APPARATUS OF ELECTRONIC MUSICAL INSTRUMENT

(75) Inventor: Ichiro Osuga, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 12/211,678

(22) Filed: Sep. 16, 2008

(65) Prior Publication Data

US 2009/0078107 A1 Mar. 26, 2009

(30) Foreign Application Priority Data

Sep. 21, 2007 (JP) ..... 2007-245105
Sep. 28, 2007 (JP) ..... 2007-254104

(51) Int. Cl.
*G10C 3/12* (2006.01)

(52) U.S. Cl. ..... 84/423 R; 84/433; 84/719

(58) Field of Classification Search ..... 84/423 R, 84/433, 719
See application file for complete search history.

(56) References Cited

U.S. PATENT DOCUMENTS 4,901,614 A * 2/1990 Kumano et al. ..... 84/719
4,914,999 A 4/1990 Masubuchi et al.
5,243,125 A * 9/1993 Yamaguchi ..... 84/745
5,249,497 A * 10/1993 Niitsuma ..... 84/247
5,571,983 A * 11/1996 Yamaguchi et al. ..... 84/745
5,574,241 A * 11/1996 Kumano et al. ..... 84/439
5,610,352 A * 3/1997 Yamaguchi ..... 84/435
5,696,340 A * 12/1997 Ragni ..... 84/423 R
5,821,443 A 10/1998 Masubuchi et al.
5,895,875 A 4/1999 Osuga et al.
6,147,290 A * 11/2000 Uno ..... 84/433
6,191,351 B1 * 2/2001 Niitsuma ..... 84/720
6,930,234 B2 * 8/2005 Davis ..... 84/423 R
7,141,729 B2 * 11/2006 Uno et al. ..... 84/236
7,208,668 B2 * 4/2007 Shimoda ..... 84/434

(Continued)

FOREIGN PATENT DOCUMENTS

JP 2-19468 5/1990

(Continued)

OTHER PUBLICATIONS

European Search Report mailed Dec. 10, 2007, for EP Application No. 07112324.4, eight pages.

*Primary Examiner*—Jeffrey Donels
*Assistant Examiner*—Robert W Horn
(74) *Attorney, Agent, or Firm*—Morrison & Foerster LLP

(57) ABSTRACT

Keys 1, 2 are supported by a frame 3 in a freely swingable manner. Massive bodies 8, a lower limit stopper 10 and an upper limit stopper 11 are situated below keys 1, 2. Massive bodies 8 are supported by a frame 3 in a freely swingable manner and pivot in synchronization with key-depression. A lower limit stopper 10 restricts a lower limit of pivoting range of the massive bodies 8. An upper limit stopper 10 restricts an upper limit of pivoting range of the massive bodies 8. Fixing portions (erected potions) 3g1 for fixing the upper limit stopper 11 are provided on the frame 3 in one-to-one corresponding with keys 1, 2. The upper limit stopper 11 is fixed to the undersurface of the fixing portions 3g. An upper part of each fixing portion 3g is situated inside right and left side walls of each key 1, 2.

20 Claims, 6 Drawing Sheets

U.S. PATENT DOCUMENTS

| | | | | |
|---|---|---|---|---|
| 7,485,798 | B2 * | 2/2009 | Nishida | 84/644 |
| 7,541,532 | B2 * | 6/2009 | Osuga et al. | 84/436 |
| 2007/0017343 | A1 * | 1/2007 | Nishida | 84/423 R |
| 2008/0017016 | A1 | 1/2008 | Toyama | |
| 2008/0098874 | A1 * | 5/2008 | Osuga et al. | 84/433 |
| 2008/0276789 | A1 * | 11/2008 | Shimizu | 84/433 |
| 2009/0007756 | A1 * | 1/2009 | Osuga | 84/423 R |
| 2009/0007757 | A1 * | 1/2009 | Nishida | 84/433 |
| 2009/0078107 | A1 * | 3/2009 | Osuga | 84/423 R |

FOREIGN PATENT DOCUMENTS

| | | |
|---|---|---|
| JP | 414595 | 5/1992 |
| JP | 2628656 | 4/1997 |
| JP | 9198037 | 7/1997 |
| JP | 2001-125573 | 5/2001 |
| JP | 2001-296868 | 10/2001 |
| JP | 2002-369904 | 12/2002 |
| JP | 2004-117528 | 4/2004 |
| JP | 2005-189511 | 7/2005 |
| JP | 2007-163526 | 6/2007 |

* cited by examiner

KEYBOARD APPARATUS OF ELECTRONIC MUSICAL INSTRUMENT

BACKGROUND OF THE INVENTION

1. Field of the Invention

The present invention relates to a keyboard apparatus of an electronic musical instrument, the keyboard apparatus having massive bodies which pivot in synchronization with key-depression.

2. Description of the Related Art

Conventionally, a keyboard apparatus of an electronic musical instrument is designed such that massive bodies pivot in synchronization with key-depression in order to provide its players with the feeling of key touch, more specifically, the feeling of mass and the feeling of stop similar to those offered by a keyboard mechanism of an acoustic piano.

A keyboard apparatus disclosed in Japanese Unexamined Patent Publication No. H9-198037 has an upper surface board provided on a rear part of a casing which accommodates the rear end (key fulcrum) of respective key main bodies. To the undersurface of the upper surface board, a stopper (upper limit stopper) is fixed. Bent portions (mass concentrated portions, free ends) of spindles (massive bodies) extend far behind the rear end of the key main bodies. At the time of key-depressions, the bent portions collide with the upper limit stopper. According to this structure, the depth of the keyboard apparatus has to be large. Furthermore, the stroke length of the free end increases with increase in the distance from a fulcrum of the spindle to the free end. Therefore, unless the angle at which the massive bodies pivot is reduced, the height of the keyboard apparatus is made high.

In Japanese Unexamined Patent Publication No. H4-142595 and Japanese Examined Patent Publication No. H2-019468, keyboard apparatuses in which the above-described massive bodies are placed below the keys are disclosed. In these cases, the depth of the keyboard apparatuses is the same as that of a keyboard apparatus having no massive bodies.

In the keyboard apparatus disclosed in Japanese Unexamined Patent Publication No. H4-142595, hammer arms (massive bodies) are provided on the undersurface of a keyboard chassis (frame) situated in front of axes (key fulcrums). However, the height of the keyboard apparatus is obtained by adding a sidewall of a key, a stroke length of a key, a clearance between a key and the keyboard chassis, a thickness of the keyboard chassis, a thickness of a stopper member (upper limit stopper), a stroke length of a hammer arm, a height of a hammer arm, a thickness of a damping member (lower limit stopper), and the like. By providing the hammer arms, therefore, a problem that the shape of the keyboard apparatus becomes higher to make the electronic musical instrument bulky arises.

In the keyboard apparatus disclosed in Japanese Examined Patent Publication No. H2-019468, axes (pivot fulcrums) of respective arms (massive bodies) are fit into concave portions provided on right and left side walls of the respective keys, with cushion members (upper limit stoppers) of the arms being provided on a ceiling surface located inside the respective keys. When a key is depressed, the arm gets into the inside sandwiched between the right and left side walls of the key. Therefore, because unused space which is situated inside the right and left side walls of the respective keys is utilized, the height of the keyboard apparatus can be reduced. However, because the cushion member is placed inside the respective keys, a problem that a shock caused by collision of the arm with the cushion member is perceived by a player with his finger through a key arises. In addition, because the cushion member has to be provided for the individual keys, a problem that the conventional apparatus decreases the efficiency of assembly to require more assembly cost, compared with a case where all the keys share a cushion member.

DISCLOSURE OF THE INVENTION

Problems to be Solved by the Invention

The present invention was accomplished to solve the above-described problems, and an object thereof is to provide a keyboard apparatus of an electronic musical instrument having massive bodies which pivot in synchronization with key-depression, the keyboard apparatus having a reduced height of the apparatus without the need for increasing the depth of the apparatus, and offering a favorable feeling of stop to a player.

It is a feature of the present invention to provide a keyboard apparatus of an electronic musical instrument, the keyboard apparatus including a plurality of keys; a plurality of massive bodies situated below the plurality of keys in a one-to-one correspondence with the keys, each massive body pivoting in synchronization with key-depression of its corresponding key; a frame on which the plurality of keys and the plurality of massive bodies are arranged in parallel; an upper limit stopper member which is placed below the plurality of keys to be fixed to the frame side such that a collision of each massive body with the upper limit stopper member results in restriction on upper limit of pivoting range of the each massive body; a lower limit stopper member which is placed below the plurality of keys to be fixed to the frame side such that a collision of each massive body with the lower limit stopper member results in restriction on lower limit of pivoting range of the each massive body; and a plurality of fixing portions provided on the frame in a one-to-one correspondence with the plurality of keys, at least an upper part of each fixing portion being situated inside right and left side walls of its corresponding key, each fixing portion having an undersurface to which the upper limit stopper member is fixed.

According to the feature of the present invention, the plurality of massive bodies, the upper limit stopper member and the lower limit stopper member are situated below the plurality of keys, resulting in the need for increasing the depth of the apparatus being eliminated. In addition, the fixing portions are provided not on the key main body side but on the frame side, resulting in a favorable feeling of stop being offered to the player. In order to provide the fixing portions, the unused inner space between the right and left side walls of each key is efficiently used. As a result, the overlaying of each fixing portion with the right and left side walls of its corresponding key contributes reduction in height of the keyboard apparatus. Furthermore, in a case where even the undersurface of each fixing portion is provided inside the right and left side walls of each key, the position of the respective fixing portions is raised, compared to the conventional case where the fixing portions are provided on the frame side. As a result, the height of the keyboard apparatus according to the feature can be reduced, compared to the conventional case.

Consequently, the outside shape of the electronic musical instrument equipped with the keyboard apparatus can be thinned. In a case where the electronic musical instrument is designed to have the same height as a conventional electronic musical instrument, the electronic musical instrument according to the present invention can expand space provided on an upper portion located behind the keys of the keyboard apparatus for implementing functional parts of the electronic musical instrument such as switches provided on an operating panel and indicators.

It is another feature of the present invention that, in the above-described configuration, each of the plurality of fixing portions has a vertical rib situated on an upper surface side of the each fixing portion. According to the feature, because the vertical rib increases stiffness of the fixing portion, a collision of a massive body with the upper limit stopper member causes less deformation of the fixing portion, resulting in an improved feeling of stop being delivered to a finger of the player.

It is still another feature of the present invention that, in the above-described configuration, the undersurface of the each fixing portion is situated below lower end surface of right and left side walls of its corresponding key even in a state where the corresponding key has been depressed. The upper limit stopper member is shaped like a ribbon whose longitudinal direction coincides with a direction in which the plurality of keys are arranged, and continuously extends over at least two neighboring keys to be fixed to the undersurface of the respective fixing portions provided for the at least two keys. Accordingly, the upper limit stopper member is fixed to the undersurface of the respective fixing portions of at least two neighboring keys which correspond to all the keys of the keyboard, keys included in an octave to a few octaves, etc. As a result, compared with a case where the action restricting member is provided for each fixing portion to be fixed separately, the feature of the present invention improves the efficiency of assembly of the keyboard apparatus.

It is a further feature of the present invention to provide a keyboard apparatus of an electronic musical instrument, the keyboard apparatus including a plurality of keys; a plurality of massive bodies situated below the plurality of keys in a one-to-one correspondence with the keys, each massive body pivoting in synchronization with key-depression of its corresponding key; a frame on which the plurality of keys and the plurality of massive bodies are arranged in parallel; an upper limit stopper member which is placed below the plurality of keys to be fixed to the frame side such that a collision of each massive body with the upper limit stopper member results in restriction on upper limit of pivoting range of the each massive body; and a lower limit stopper member which is placed below the plurality of keys to be fixed to the frame side such that a collision of each massive body with the lower limit stopper member results in restriction on lower limit of pivoting range of the each massive body. The each massive body has a first contact portion which comes into contact with the upper limit stopper member in a state where a key corresponding to the each massive body has been depressed and a second contact portion which comes into contact with the lower limit stopper member in a state where the corresponding key has been released. The first contact portion is situated close to a free end of the each massive body with the second contact portion being situated closer to a pivot fulcrum side of the each massive body than the first contact portion. The second contact portion is situated in a position higher than the lowest end of the first contact portion in a state where the key corresponding to the each massive body has been released.

According to the feature as well, the plurality of massive bodies, the upper limit stopper member and the lower limit stopper member are situated below the plurality of keys, resulting in the need for increasing the depth of the apparatus being eliminated. In addition, in a state where the corresponding key has been depressed, the first contact portion which comes into contact with the upper limit stopper member placed on the frame side is situated in the vicinity of the free end ("vicinity" can include and exclude the free end), resulting in a favorable feeling of stop being offered to the player. Because collision of each massive body with the lower limit stopper member is caused only by gravity without any key-depression force, an impact brought about by the collision is small. Therefore, although the second contact part which comes into contact with the lower limit stopper member is situated on the pivot fulcrum side of the massive body, deformation of the massive body will not present any problem at the collision of the massive body with the lower limit stopper member. Because the second contact portion is situated in a position higher than the lowest end of the first contact portion in the state where the key has been released, the height of the apparatus will not be raised due to the thickness of the lower limit stopper member.

Consequently, the outside shape of the electronic musical instrument equipped with the keyboard apparatus can be thinned. In a case where the electronic musical instrument is designed to have the same height as a conventional electronic musical instrument, the electronic musical instrument according to the present invention can expand space provided on an upper portion located behind the keys of the keyboard apparatus for implementing functional parts of the electronic musical instrument such as switches provided on an operating panel and indicators.

It is a still further feature of the present invention that, in the above-described configuration, the each massive body is designed such that an upper portion of the each massive body is situated inside right and left side walls of the key corresponding to the each massive body in a state where the corresponding key has been depressed. According to the feature, the free space which is situated inside the right and left side walls of each key main body is efficiently used to increase the mass of each massive body in accordance with the overlaying of each massive body with the right and left side walls of each key, resulting in increased inertial moment of each massive body.

It is another feature of the present invention that, in the above-described configuration, the each massive body has a concave portion which is open downward such that a ceiling surface of the concave portion serves as the second contact portion to come into contact with the lower limit stopper member in a state where the corresponding key has been released. According to the feature, the mass placed on the front and the rear of the concave portion is effectively used to increase the inertial moment. As long as each massive body is configured by connecting the pivot fulcrum to the mass concentrated portion through the connecting portion, the above-described concave portion can be placed on the mass concentrated portion.

DESCRIPTION OF THE PREFERRED EMBODIMENT a. First Embodiment

Figure 1A:
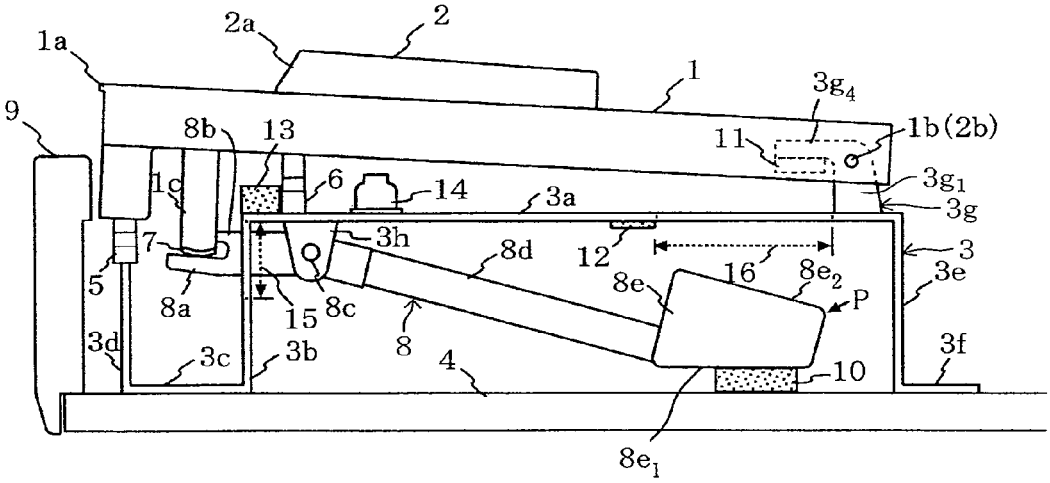
FIG. 1A is a right side view schematically showing a keyboard apparatus of an electronic musical instrument, the keyboard apparatus being a first embodiment of the present invention.
Figure 1B:
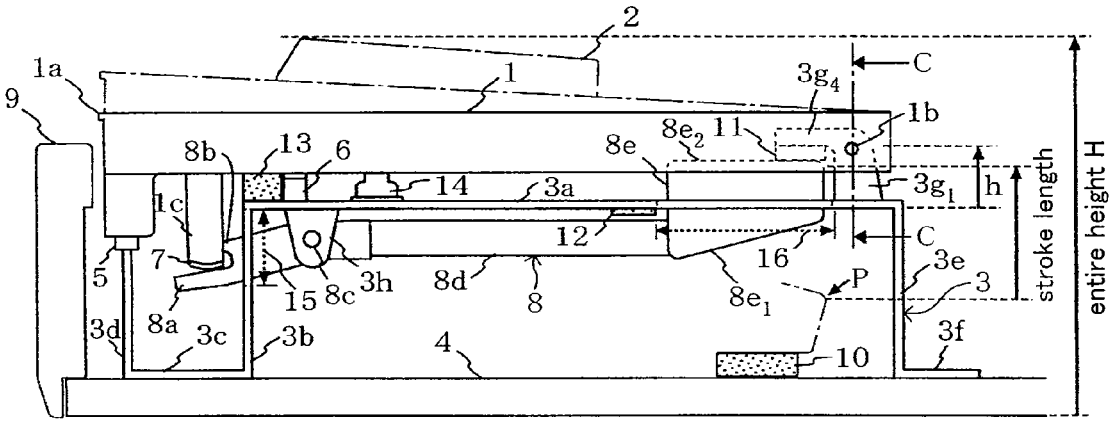
FIG. 1B is a right side view of the keyboard apparatus shown in FIG. 1A, the keyboard apparatus being in a state where a white key has been depressed.
Figure 1C:
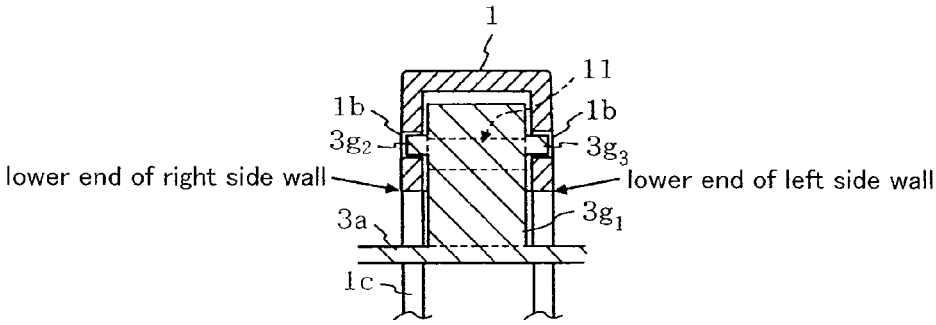
FIG. 1C is a vertical section view showing a white key main body and a black key main body shown in FIG. 1B when viewed along an arrow C-C.

FIG. 1A and FIG. 1B are right side views schematically showing a keyboard apparatus of an electronic musical instrument, the keyboard apparatus being a first embodiment of the present invention. FIG. 1A shows a state (key-release state) in which a key has not been depressed. FIG. 1B shows a state in which a white key main body 1 has been depressed. FIG. 1C is a vertical section view schematically showing the white key main body 1 and a key frame 3 shown in FIG. 1B when viewed along an arrow C-C.

This keyboard apparatus has the white key main bodies 1, black key main bodies 2, the key frame 3, a key frame bottom board 4 and massive bodies 8. The key frame 3 extends in a direction in which the plurality of keys are arranged. The key frame 3 is made of sheet metal or synthetic resin, for example. Respective parts (having alphabetical subscripts) of the key frame 3 are molded in one piece. On an upper mount portion 3*a* of the key frame 3, the plurality of white key main bodies 1 and the plurality of black key main bodies 2 are arranged in parallel. In the shown example, the upper mount portion 3*a* is horizontal and has a step portion 3*b*. The step portion 3*b* is placed at the front part in the longitudinal direction (depth direction) of the keys. The step portion 3*b* has a plurality of penetrating holes 15 shaped like slits. The plurality of penetrating holes 15 correspond to the plurality of keys.

The key frame 3 has a base portion 3*c* placed forward of the step portion 3*b*. The base portion 3*c* is provided in order to mount the key frame 3 on the key frame bottom board 4. A vertical wall 3*d* is placed forward of the base portion 3*c*. On the vertical wall 3*d*, a plurality of key guides 5 are provided. The respective key guides 5 are inserted into a lower part of a tip 1*a* of the respective white key main bodies 1. A plurality of key guides 6 provided for the black key main bodies 2 are erected on the upper mount portion 3*a*. The lower part of the tips 1*a* of the white key main bodies, the key guides 5, the vertical wall 3*d* and the front of the key frame bottom board 4 are covered with a mouth stick 9.

The upper mount portion 3*a* has a step portion 3*e*. The step portion 3*e* is placed at the rear part in the longitudinal direction of the keys. The key frame 3 has a base portion 3*f* placed behind the step portion 3*e*. The base portion 3*f* is provided in order to mount the key frame 3 on the key frame bottom board 4. On a top surface of the vicinity of the rear end of the upper mount portion 3*a*, a plurality of supporting portions 3*g* are arranged so as to correspond to the plurality of white key main bodies 1 and the plurality of black key main bodies 2. The respective supporting portions 3*g* support the respective keys in a freely swingable manner. Each of the supporting portions 3*g* has an erected portion 3*g*1 and a forward overhanging portion 3*g*4. The erected portion 3*g*1 protrudes upward from the upper mount portion 3*a*. On the rear of the upper mount portion 3*a*, a plurality of penetrating holes 16 shaped like slits are provided forward of the supporting portions 3*g* to correspond to the respective keys.

As shown in FIG. 1C, each of the supporting portions 3*g* has axis portions 3*g*2, 3*g*3 provided on the upper part of the right and left side surfaces. The axis portions 3*g*2, 3*g*3 overhang in the direction in which the keys are arranged. Into the axis portions 3*g*2, 3*g*3, a key fulcrum 1*b* (penetrating hole) provided on the right and left side walls of the rear end of the white key main body 1 is fitted. Supporting portions 3*g* which are not shown and correspond to the black key main bodies 2 are configured similarly. Into the axis portions 3*g*2, 3*g*3, more specifically, a key fulcrum 2*b* (penetrating hole) provided on the right and left side walls of the rear end of the black key main body 2 is fitted.

An upper part of the erected portion 3*g*1 shown in FIG. 1A horizontally overhangs frontward to have the flat-shaped forward overhanging portion (fixing portion) 3*g*4. To the undersurface (in the shown example, the horizontal surface) of the forward overhanging portion 3*g*4, an upper limit stopper (upper limit stopper member) 11 is fixed. Inside the right and left side walls of the white key main body 1 and the black key main body 2, there is space situated inside the key, the space being open downward. The forward overhanging portion 3*g*4 and the upper limit stopper 11 provided for each white key main body 1 and black key main body 2 are situated inside the right and left side walls of the white key main body 1 or the black key main body 2. More specifically, the forward overhanging portion 3*g*4 and the upper limit stopper 11 are provided so as to be overlaid with the right and left side walls of the white key main body 1 or the black key main body 2 without interfering with the right and left side walls of the white key main body 1 or the black key main body 2.

On the upper surface of the upper mount portion 3*a* of the key frame 3, a plurality of key switches 14 are arranged. Opposed to the plurality of key switches 14, a protruding portion (actuator) is provided in the space situated inside the right and left side walls of each of the white key main bodies 1 and the black key main bodies 2. More specifically, the protruding portion protrudes downward from the undersurface of the top surface of each key. In FIG. 1C as well, the protruding portion is not shown. On the undersurface of the upper mount portion 3*a*, massive body supporting portions 3*h* are erected in the vicinity of the front end of the upper mount portion 3*a*. The shown massive body supporting portion 3*h* is provided for the white key main body 1. Downward from the lower end of the right and left side walls of the vicinity of the tip 1*a* of the white key main body, a force conveying portion 1*c* extends. A tip of the force conveying portion 1*c* has a bottom board. An upper portion of the bottom board penetrates in the longitudinal direction of the key. To the upper surface and the undersurface of the bottom board, an elastic member 7 is fixed.

A force conveying portion of the black key main body 2 is not shown but extends downward from a tip 2*a* of the black key main body. The lower end of the force conveying portion of the black key main body 2 faces frontward. The position of the force conveying portions of the black key main bodies 2 is overlaid with that of the force conveying portions 1*c* in the direction in which the keys are arranged. For each of the black key main bodies 2 as well, a similar massive body pivotably supported by a massive body supporting portion is similarly provided. Each of the massive bodies provided for the black key main bodies 2 is engaged with the bottom board of the force conveying portion of the corresponding black key main body 2 through the elastic member. The respective white key main bodies 1 and black key main bodies 2 recover to their respective original positions because of the self weight of their corresponding massive body 8. Between the white key main bodies 1 and the key frame 3, and between the black key main bodies 2 and the key frame 3, however, recovery springs for recovering the white key main bodies 1 and the black key main bodies 2 to their key-release positions may be provided, respectively.

The plurality of massive bodies 8, a lower limit stopper 10 and the upper limit stoppers 11 are situated below (including the space situated inside the respective keys) the plurality of white key main bodies 1 and the plurality of black key main bodies 2 (keyboard surface). The respective massive bodies 8 correspond to the respective white key main bodies 1 and the black key main bodies 2. Each massive body 8 pivots in synchronization with a key-depression of its corresponding key main body. The shown massive body 8 is provided for the white key main body 1. The massive body 8 has a pivot fulcrum 8*c* supported by the massive body supporting portion 3*h*, a main driven portion 8*a* and a secondary driven portion 8*b* which are bifurcated and installed forward of the pivot fulcrum 8*c* to be engaged with the force conveying portion 1*c* of the key through the elastic member 7, and a mass concentrated portion 8*e* which is situated behind the pivot fulcrum 8*c* with a connecting portion 8*d* sandwiched in between and serves as a free end.

The rear end of the connecting portion 8*d* is connected to the lower portion of the front end of the mass concentrated portion 8*e*. The width of the mass concentrated portion 8*e* along the arranged keys is smaller than the inner width between the right and left side walls of each key. A shown point P is a point which is the furthest from the pivot fulcrum 8*c*. In this specification, such a point is referred to as a free end. The connecting portion 8*d* and the mass concentrated portion 8*e* produce a large inertial moment when pivoting. The massive body 8 penetrates the penetrating hole 15 between the driven portion 8*a*, 8*b* and the pivot fulcrum 8*c*. In the shown example, a lower end surface 8*e*1 of the mass concentrated portion 8*e* is kept horizontal. The lower end surface 8*e*1 serves as a contact part which comes into contact with the lower limit stopper 10 (lower limit stopper member). The lower limit stopper 10 is fastened to the upper surface of the key frame bottom board 4. In the shown example, an upper end surface 8*e*2 of the mass concentrated portion 8*e* is an inclined surface where the rear is lower than the front. As shown in FIG. 1B, however, the upper end surface 8*e*2 becomes horizontal when the key has been depressed.

In the key-release state shown in FIG. 1A where the key has been released, if the key main body (in the shown example, the white key main body 1) is depressed, the massive body 8 corresponding to the key pivots counterclockwise in spite of gravity. The upper end surface 8*e*2 of the mass concentrated portion 8*e* passes through the penetrating hole 16. During this, a counteraction according to the inertial moment of the massive body 8 is conveyed to the white key main body 1, resulting in a feeling of mass being delivered to a finger of a player. As shown in FIG. 1B, the connecting portion 8*d* of the massive body becomes horizontal to collide the upper end surface 8*e*2 of the mass concentrated portion 8*e* with the upper limit stopper (upper limit stopper member) 11, resulting in restriction on the upper limit of the pivoting massive body 8. Because the restriction on the pivoting of the massive body 8 also involves damping of the massive body 8, the player will recognize a feeling of stop with his finger through the key. The free end P of the mass concentrated portion 8*e* is to travel a distance shown in FIG. 1B as "stroke length".

The above-described forward overhanging portion 3*g*4 is provided not on the white key main body 1 and the black key main body 2 side but on the key frame 3 side. Therefore, an impact caused by a collision of the upper end surface 8*e*2 of the mass concentrated portion with the upper limit stopper 11 will not be conveyed to a finger of the player through the key. The forward overhanging portions 3*g*4 can have a thickness larger than that of the upper mount portion 3*a* of the key frame. In addition, the erected portions 3*g*1 can have high stiffness. Furthermore, the erected portions 3*g*1 are placed near the step portion 3*e*. As a result, such a structure makes it easy to prevent deformation (distortion) of the forward overhanging portions 3*g*4 to which the upper limit stopper 11 is fixed.

On the undersurface of the upper mount portion 3*a* of the key frame 3, an auxiliary stopper 12 is provided so as to adjoin to the front end of the penetrating hole 16 in the shown example. If a key-depression causes the massive body 8 to transiently exceed (over-stroke) the upper limit (fully depressed standstill position) of the pivoting of the massive body 8, the auxiliary stopper 12 prevents collision of the connecting portion 8*d* with the upper mount portion 3*a* of the key frame. In a case where there is no possibility of collision of the connecting portions 8*d* with the upper mount portion 3*a* of the key frame 3, however, the auxiliary stopper 12 is not necessary.

If the player releases the key, the massive body 8 pivots in a reverse direction because of its self weight to return to the position shown in FIG. 1A. As a result, the lower end surface 8*e*1 of the mass concentrated portion 8*e* collides with the lower limit stopper 10, resulting in the initial position of the massive body 8 (key-release state) being defined. Because the lower end surface 8*e*1 of the mass concentrated portion 8*e* in which the mass of the massive body 8 concentrates has a contact part (the second contact part) which comes into contact with the lower limit stopper 10, deterioration in the feeling of stop such as rebound and vibration at the time of key-release can be reduced.

When the white key main body 1 or the black key main body 2 is depressed, on the other hand, a lower limit stopper 13 provided on the upper surface of the front part of the upper mount portion 3*a* of the key frame restricts lower limit of the lower end of the right and left side walls of the depressed white key main body 1 or black key main body 2. By arranging the above-described lower limit stopper 10, auxiliary stopper 12 and lower limit stopper 13 like ribbons along the arranged keys, the lower limit stopper 10, the auxiliary stopper 12 and the lower limit stopper 13 can be shared by all the keys or by a plurality of keys included in an octave or a few octaves.

The conventional massive body disclosed in Japanese Unexamined Patent Publication No. H4-142595 described above comes into contact with an upper limit stopper fastened to the undersurface of a key frame when a corresponding key is depressed. In the first embodiment, unlike the conventional structure, the upper limit stopper 11 is provided on the undersurface of the forward overhanging portion 3*g*4 which is located in a position higher than the undersurface of the upper mount portion 3*a*. As a result, the position of the upper limit stopper 11 is displaced upward by a distance h shown in FIG. 1B. The displacement of the position of the upper limit stopper 11 also involves upward displacement of the massive body 8 and the lower limit stopper 10 compared to the conventional structure, resulting in the arrangement shown in FIGS. 1A to 1C. More specifically, the height of the upper mount portion 3*a* is lowered by the distance h compared to the conventional art. Consequently, the reduction in the height of the upper mount portion 3*a* contributes reduction in the entire height H of the keyboard apparatus when compared to the conventional art.

The above-described reduction can be achieved as long as the undersurface of the forward overhanging portions 3*g*4 is located in a position higher than the undersurface of the upper mount portion 3*a* of the key frame. In the first embodiment, however, in order to place the upper limit stoppers 11 at a position higher than the undersurface of the upper mount portion 3*a* of the key frame 3 as much as possible, the forward overhanging portions 3*g*4 are provided inside the right and left side walls of the respective white key main bodies 1 and the black key main bodies 2 (space in a direction of height of the keyboard). In this case, adequate clearance between the undersurface of the forward overhanging portions 3*g*4 and the upper mount portion 3*a* of the key frame is provided. Such a structure of the first embodiment offers an advantage that placing the upper limit stoppers 11 on the undersurface of the forward overhanging portions 3*g*4 and fastening the upper limit stoppers 11 to the undersurface of the forward overhanging portions 3*g*4 are facilitated.

As long as at least the upper part of the respective forward overhanging portions (fixing portions) 3*g*4 is provided inside the right and left side walls of the respective white key main bodies 1 and the black key main bodies 2, it is considered that the unused inner space between the right and left side walls of each key is efficiently used to accommodate the forward overhanging portions 3*g*4. As a result, the overlaying of the forward overhanging portions 3*g*4 with the right and left side walls of the keys contributes reduction in height of the keyboard apparatus.

In the above-described explanation, the plurality of key switches 14 are arranged on the upper surface of the upper mount portion 3*a* of the key frame 3. Instead of the above-described structure, as described in Japanese Unexamined Patent Publication No. H9-198037 mentioned above, a protruding portion (actuator) may be provided on the lower end surface of each of the massive bodies 8, for example, on the lower end surface between the main driven portion 8*a* and the pivot fulcrum 8*c* so as to place. And, a circuit board on which the key switch 14 is placed below the protruding portion.

The above-described supporting portions 3*g* support not only the white key main bodies 1 and the black key main bodies 2 but also the forward overhanging portions 3*g*4 which serve as fixing portions to which the upper limit stoppers 11 are fixed. Instead of this structure, supporting portions for supporting the white key main bodies 1 and the black key main bodies 2 and supporting portions for supporting fixing portions of the upper limit stoppers 11 may be provided separately. In a case where such separate supporting portions are employed, the supporting members of the white key main bodies 1 and the black key main bodies 2 can be replaced with different members which are not formed of the shown key fulcrum (penetrating hole) and axes.

In a case where the key frame 3 is made of synthetic resin, the plurality of supporting portions 3*g* provided for the respective keys can be formed in one piece as part of the key frame 3. However, the supporting portions 3*g* may be formed separately from the key frame 3 so that the supporting portions 3*g* are provided on the key frame 3 at the time of assembly. The upper limit stoppers 11 may be formed integrally with the supporting portions 3*g* by two-color molding. Alternatively, the upper limit stoppers 11 may be bonded to the undersurface of the forward overhanging portions 3*g*4, respectively.

The stopper members including the above-described upper limit stoppers 11 are required to have restoring force in view of impact absorbability, noise deadening, and reproducibility of stop position of the white key main bodies 1 and the black key main bodies 2, and reproducibility of stop position of the massive bodies 8. More specifically, the stopper members employ an action restricting member such as felt or polyurethane elastomer. In the massive body 8, members from the main driven portion 8*a* and the secondary driven portion 8*b* to the pivot fulcrum 8*c* are formed of synthetic resin or the like in one piece to serve as a base of the massive body 8. The base is formed in one piece by outsert molding in a state where the metal connecting portion 8*d* is inserted into a die, for example. The mass concentrated portion 8*e* is made of metal, being formed integrally with the connecting portion 8*d*, for example.

b. Second Embodiment

Figure 2A:
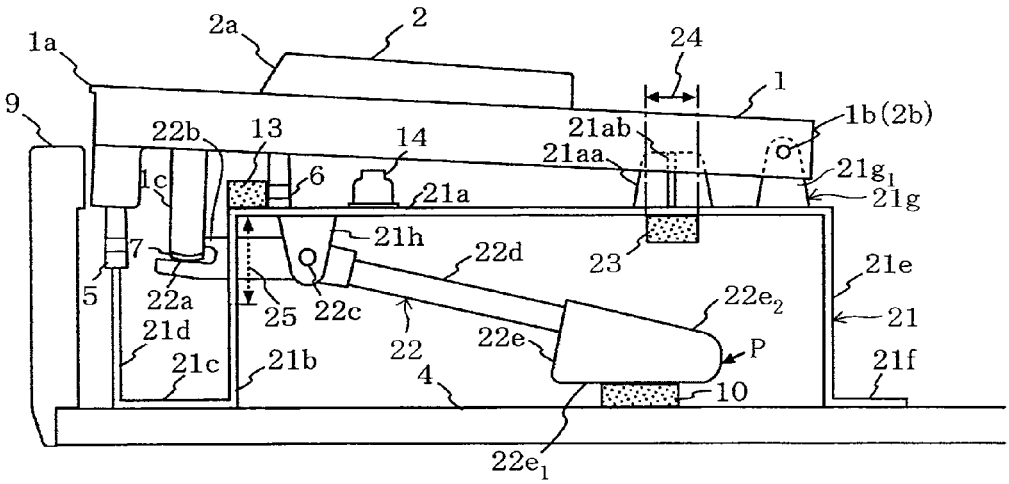
FIG. 2A is a right side view schematically showing a keyboard apparatus of an electronic musical instrument, the keyboard apparatus being a second embodiment of the present invention.
Figure 2B:
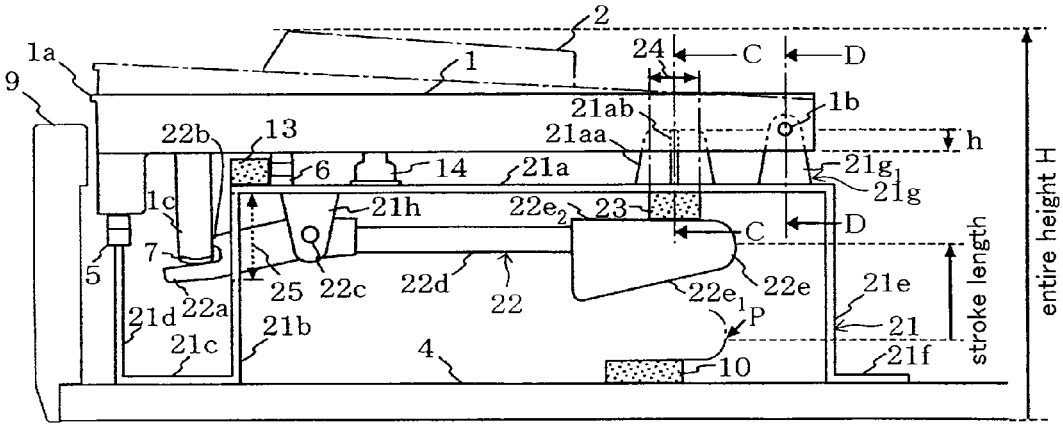
FIG. 2B is a right side view of the keyboard apparatus shown in FIG. 2A, the keyboard apparatus being in a state where a white key has been depressed.
Figure 2C:
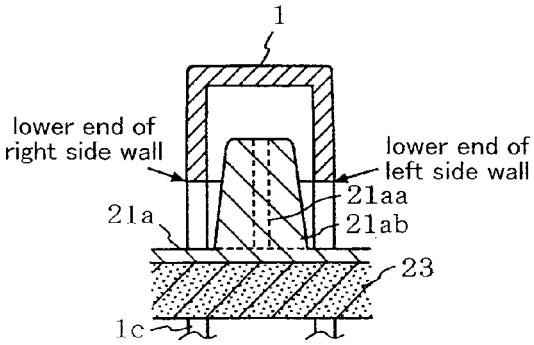
FIG. 2C is a vertical section view showing the white key main body and the black key main body shown in FIG. 2B when viewed along an arrow C-C.
Figure 2D:
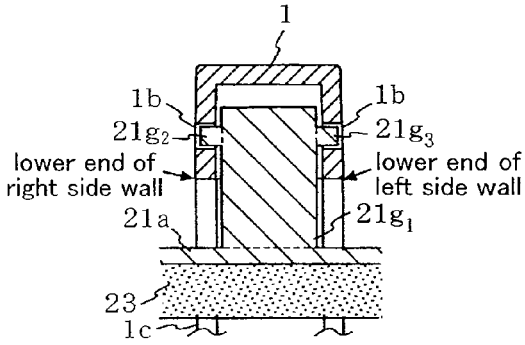
FIG. 2D is a vertical section view showing the white key main body and the black key main body shown in FIG. 2B when viewed along an arrow D-D.

FIG. 2A and FIG. 2B are right side views schematically showing a keyboard apparatus of an electronic musical instrument, the keyboard apparatus being a second embodiment of the present invention. FIG. 2A shows a key-release state in which a key has not been depressed. FIG. 2B shows a state in which the white key main body 1 has been depressed. FIG. 2C is a vertical section view schematically showing the white key main body 1, a key frame 21 and an upper limit stopper 23 when viewed along an arrow C-C in FIG. 2B. FIG. 2D is a vertical section view schematically showing the white key main body 1 and the key frame 21 when viewed along an arrow D-D in FIG. 2B. In these figures, parts similar to those shown in FIGS. 1A to 1C are given the same numbers to omit detailed explanations.

A general structure of the key frame 21 is similar to that of the key frame 3 shown in FIGS. 1A to 1C. The key frame 21 has an upper mount portion 21*a*, a step portion 21*b*, a base portion 21*c*, a vertical wall 21*d*, a step portion 21*e* and a base 21*f*.

In the vicinity of the rear end of the upper mount portion 21*a*, a plurality of supporting portions 21*g* are erected. The plurality of supporting portions 21*g* support their corresponding white key main bodies 1 and black key main bodies 2 in a freely swingable manner. As shown in FIG. 2D, an erected portion 21*g*1 of each supporting portion 21*g* protrudes from the upper surface of the upper mount portion 21*a*. From upper part of the right and left side surfaces of the erected portion 21*g*1, an axis portions 21*g*2, 21*g*3 protrude in the direction in which the keys are arranged. Into the axis portions 21*g*2, 21*g*3, the key fulcrum (penetrating hole) 1*b* or the key fulcrum (penetrating hole) 2*b* provided on the right and left side walls of the rear end of the white key main body 1 or the black key main body 2 is fitted. The upper part of the respective supporting portions 21*g* is placed between the right and left vertical side walls of the respective white key main bodies 1. The supporting portions 21*g* are formed integrally with the key frame 21. Alternatively, the supporting portions 21*g* may be formed separately from the key frame 21.

Massive bodies 22 are arranged below (including space inside the respective keys) the plurality of white key main bodies 1 and the plurality of black key main bodies 2 (keyboard surface) to correspond to the respective white key main bodies 1 and the respective black key main bodies 2. A general structure of the massive bodies 22 is almost the same as that of the massive bodies 8 shown in FIG. 1A and FIG. 1B. Each of the massive bodies 22 is supported by a massive body supporting portion 21*h* to pivot through a force conveying portion 1*c* of a corresponding key. Each of the massive bodies 22 has a main driven portion 22*a*, a secondary driven portion 22*b*, a pivot fulcrum 22*c*, a connecting portion 22*d* and a mass concentrated portion 22*e* serving as a free end. The rear end of the connecting portion 22*d* is connected to the upper part of the front end of the mass concentrated portion 22*e*. On the step portion 21*b* of the key frame 21, a plurality of penetrating holes 25 which are shaped like slits are provided to correspond to the plurality of keys, respectively. The respective massive bodies 22 penetrate the respective penetrating holes 25. On the undersurface of the upper mount portion 21*a*, an upper limit stopper 23 is provided, being fastened to the undersurface in front of the supporting portions 21*g*. The upper limit stopper 23 is formed like a ribbon whose longitudinal direction coincides with the direction in which the plurality of keys are arranged. The upper limit stopper 23 is shared by all the keys included in the keyboard or by a plurality of keys included in an octave or in a few octaves.

In an initial state shown in FIG. 2A, a lower end surface 22*e*1 of the mass concentrated portion 22*e* is in contact with the lower limit stopper (lower limit stopper member) 10. When the key is depressed, the massive body 22 corresponding to the key pivots counterclockwise in spite of gravity. As shown in FIG. 2B, the connecting portion 22*d* of the massive body 22 becomes horizontal, so that an upper end surface 22*e*2 of the mass concentrated portion 22*e* collides with the upper limit stopper (upper limit stopper member) 23. The free end P travels a distance shown as "stroke length". The black key main body 2 also has a force conveying portion, also being provided with a similar massive body pivotably supported by a massive body supporting portion. Therefore, the massive body of the black key main body 2 pivots through the force conveying portion of the corresponding black key.

When the mass concentrated portion 22*e* collides with the upper limit stopper 23, the player will recognize a feeling of stop with his finger through the key. However, if an upper limit stopper fixing portion (fixing portion) 24 being situated on an upper mount portion 21*a* and having the undersurface to which the upper limit stopper 23 is fixed is deformed (distorted), the feeling of stop deteriorates. In a case where the key frame 21 is made of synthetic resin, in particular, the upper limit stopper fixing portion 24 is prone to deformation. By forming vertical ribs 21*aa*, 21*ab* on the upper surface of the upper limit stopper fixing portion 24 on the upper mount portion 21*a*, therefore, the upper limit stopper fixing portion 24 strengthens and improves stiffness.

The shown vertical rib 21*aa* is a thin plate formed at a position corresponding to the midpoint of the right and left side walls (midpoint in the direction in which the keys are arranged) of the white key main body 1 and the black key main body 2 and extending in the longitudinal direction of the key. The vertical rib 21*ab* is a thin plate extending from the midpoint of the vertical rib 21*aa* laterally in the direction in which the keys are arranged. The vertical rib 21*aa* and the vertical rib 21*ab* form the vertical ribs shaped like a cross. Only either of the ribs may be provided. Particularly, only the vertical rib 21*aa* which improves stiffness in the longitudinal direction of the key which is prone to deformation (distortion) may be provided. The above-described upper limit stopper fixing portion 24 is a structure in which the vertical ribs 21*aa*, 21*ab* are added to the upper mount portion 21*a*. Consequently, the upper limit stopper fixing portions 24 are provided to correspond to the respective keys (the respective massive bodies). More specifically, the upper part of the respective upper limit stopper fixing portions 24, in other words, the upper part of the respective vertical ribs 21*aa*, 21*ab* is situated inside the right and left side walls of the respective white key main bodies 1 and the respective black key main bodies 2.

In a case where the vertical ribs 21*aa*, 21*ab* are placed at any given position on the upper mount portion 21*a*, the distance from the upper mount portion 21*a* to the lower end of the right and left side walls of the white key main body 1 and the black key main body 2 has to be sufficient in order to prevent the vertical ribs 21*aa*, 21*ab* from interfering with the right and left side walls of the white key main body 1 and the black key main body 2. In the second embodiment, however, the vertical ribs 21*aa*, 21*ab* are provided by making full use of free space which is situated inside the right and left side walls of the white key main body 1 or the black key main body 2. Therefore, overlaying of the vertical ribs 21*aa*, 21*ab* with the right and left side walls of the white key main body 1 or the black key main body 2 (distance h) contributes reduction in the distance from the upper mount portion 21*a* to the lower end of the right and left side walls. As a result, the entire height H of the keyboard apparatus can be reduced in comparison with the case where the vertical ribs 21*aa*, 21*ab* are placed simply in any given position. In the shown example, although the upper limit stopper 23 is fixed to the undersurface of the upper mount portion 21*a* in a manner similar to the conventional art, the height of the upper mount portion 21*a* is designed to have the reduced height of the upper mount portion 3*a* of the first embodiment shown in FIGS. 1A to 1C. As a result, this embodiment has a stroke length shorter than that of the first embodiment.

c. Third Embodiment

Figure 3A:
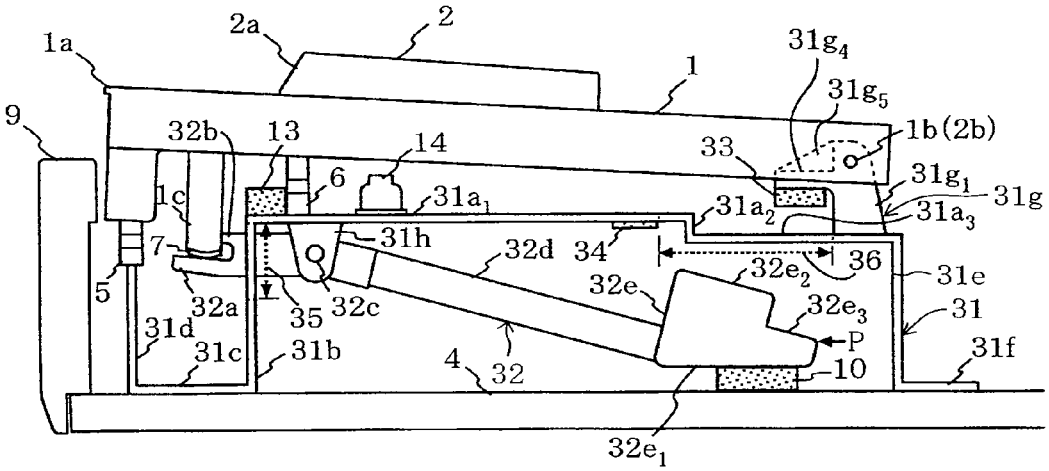
FIG. 3A is a right side view schematically showing a keyboard apparatus of an electronic musical instrument, the keyboard apparatus being a third embodiment of the present invention.
Figure 3B:
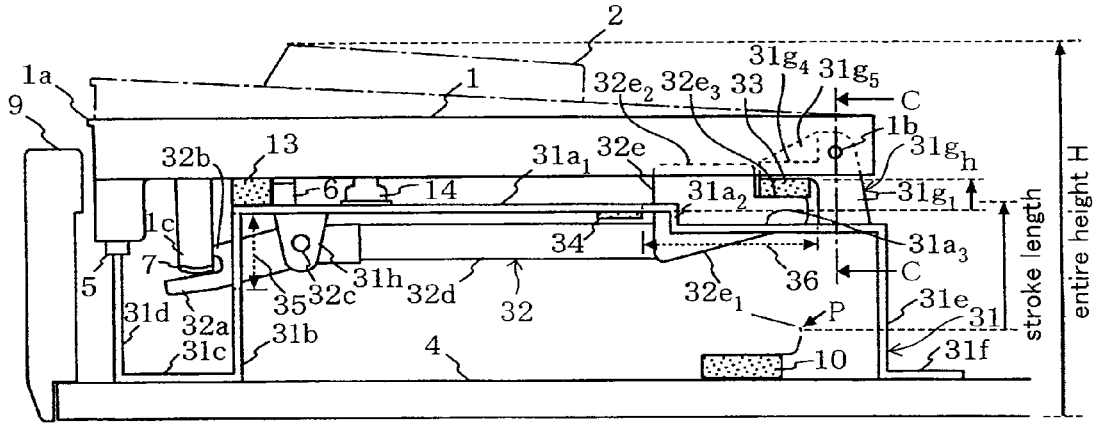
FIG. 3B is a right side view of the keyboard apparatus shown in FIG. 3A, the keyboard apparatus being in a state where a white key has been depressed.
Figure 3C:
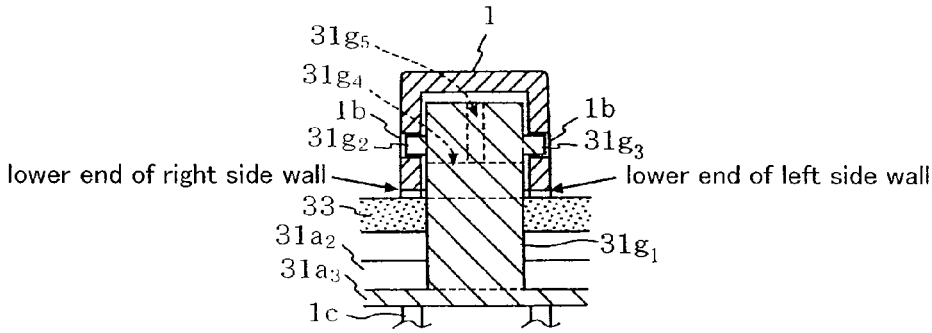
FIG. 3C is a vertical section view showing the white key main body and the black key main body shown in FIG. 3B when viewed along an arrow C-C.

FIG. 3A and FIG. 3B are right side views schematically showing a keyboard apparatus of an electronic musical instrument, the keyboard apparatus being a third embodiment of the present invention. FIG. 3A shows a key-release state in which a key has not been depressed. FIG. 3B shows a state in which the white key main body 1 has been depressed. FIG. 3C is a vertical section view schematically showing the white key main body 1 and a key frame 31 when viewed along an arrow C-C in FIG. 3B. In these figures, parts similar to those shown in FIGS. 1A to 1C are given the same numbers to omit detailed explanations.

A general structure of the key frame 31 is similar to that of the key frame 3 shown in FIGS. 1A to 1C. However, an upper mount portion 31*a* included in the key frame 31 is separated into the front and the rear. A front upper mount portion 31*a*1 is connected to a rear upper mount portion 31*a*3 which is slightly lower than the front upper mount portion 31*a*1 with a step portion 31*a*2 interposed in between. The key frame 31 has a step portion 31*b*, a base 31*c*, a vertical wall 31*d*, a step portion 31*e* and a base 31*f*. On the step portion 31*b*, a plurality of penetrating holes 35 shaped like slits are arranged in parallel to correspond to the plurality of keys.

In the vicinity of the rear end of the rear upper mount portion 31*a*3, a plurality of supporting portions 31*g* are erected upward to correspond to the plurality of white key main bodies 1 and black key main bodies 2. In the shown example, on the rear part of the front upper mount portion 31*a*1 of the key frame 31, a plurality of penetrating holes 36 shaped like slits are provided to correspond to the respective keys. Each of the penetrating holes 36 extends from the rear end of a later-described auxiliary stopper 34 to the front of the supporting portion 31*g* provided on the rear upper mount portion 31*a*3. Each of erected portions 31*g*1 has a vertical rib 31*g*5 provided between an upper portion on which axis portions 31*g*2, 31*g*3 are provided and a forward overhanging portion 31*g*4. The vertical rib 31*g*5, which is a thin plate whose longitudinal section is shaped like a triangle, is formed at the midpoint of the erected portion 31*g*1 and the forward overhanging portion 31*g*4 to correspond to the midpoint of the right and left side walls of the white key main body 1 and the black key main body 2 in the direction in which the keys are arranged. The height of the shown axis portions 31*g*2, 31*g*3 is the same as that of the axis portions 3*g*2, 3*g*3 shown in FIGS. 1A to 1C.

Because the vertical rib 31*g*5 strengthens the forward overhanging portion 31*g*4 (fixing portion), the stiffness of the forward overhanging portion 31*g*4 is improved to prevent deformation (distortion) of the forward overhanging portion 31*g*4. As a result, the feeling of stop brought about by an upper limit stopper 33 fixed to the undersurface of the forward overhanging portion 31*g*4 is improved. In the shown example, the upper portion of the forward overhanging portion 31*g*4 is situated inside the right and left side walls of the white key main body 1. However, the supporting portion 31*g* is formed such that the undersurface of the forward overhanging portion 31*g*4 is situated below the lower end of the right and left side walls of the white key main body 1 and the black key main body 2.

In order to place the upper limit stopper 33 on the undersurface of the forward overhanging portion 31*g*4 and fix the upper limit stopper 33 to the undersurface of the forward overhanging portion 31*g*4, there has to be a sufficient clearance which is larger than the thickness of the upper limit stopper 33 between the undersurface of the forward overhanging portion 31*g*4 and the upper mount portion of the key frame 31. As shown in the figures, therefore, the upper mount portion 31*a* is divided into the front and the rear so that the height of the rear upper mount portion 31*a*3 is lower than that of the front upper mount portion 31*a*1. In the first embodiment as well shown in FIGS. 1A to 1C, the upper mount portion 3*a* may be divided into the front and the rear so that the height of the rear mount portion is lower than that of the front upper mount portion.

The stroke length of the massive body and the entire height H of the keyboard apparatus of the third embodiment are designed to have those of the first embodiment shown in FIGS. 1A to 1C. However, because the supporting portion 31*g* has the vertical rib 31*g*5, the position of the undersurface of the forward overhanging portion (fixing portion) 31*g*4 cannot be raised as high as the position of the undersurface of the forward overhanging portion (fixing portion) 3*g*4 shown in FIGS. 1A to 1C. By lowering the rear part (a rear upper end surface 32*e*3) of the upper end surface of the mass concentrated portion 32*e*, therefore, the position of the surface with which the upper limit stopper 33 comes into contact is lowered.

Furthermore, the third embodiment is designed such that the undersurface of the forward overhanging portion (fixing portion) 31*g*4 to which the upper limit stopper 33 is fixed is situated below the lower end of the right and left side walls of the white key main body 1 and the black key main body 2. Therefore, the upper limit stopper 33 can be shaped like a ribbon so as to be shared by all the keys of the keyboard or by a plurality of keys included in an octave or a few octaves. In this case, the upper limit stopper 33 is fixed to the undersurface of the respective forward overhanging portions (fixing portion) 31*g*4 of the plurality of supporting portions 31*g* arranged in parallel along the keys by bonding or the like so that the upper limit stopper 33 extends over the plurality of the forward overhanging portions (fixing portions) 31*g*4.

A plurality of massive bodies 32 are arranged below (including space inside the respective keys) the plurality of white key main bodies 1 and the plurality of black key main bodies 2 (keyboard surface) in parallel so that the respective massive bodies 32 correspond to the respective white key main bodies 1 and the respective black key main bodies 2. Each massive body 32 is supported by a massive body supporting portion 31*h* to pivot through the force conveying portion 1*c* of the corresponding key. Each massive body 32 has a main driven portion 32*a*, a secondary driven portion 32*b*, a pivot fulcrum 32*c*, a connecting portion 32*d* and the mass concentrated portion 32*e* which is a free end. The rear end of the connecting portion 32*d* is connected to a lower portion of the front end of the mass concentrated portion 32*e*. The mass concentrated portion 32*e* has a lower end surface 32*e*1. A general structure of the massive body 32 is almost the same as that of the massive body 8 shown in FIG. 1A and FIG. 1B. However, the rear of the upper end surface of the mass concentrated portion 32*e* is notched to have a step so that the upper end surface is divided into a front upper end surface 32*e*2 and a rear upper end surface 32*e*3.

When the white key main body 1 is depressed, the massive body 32 corresponding to the key pivots counterclockwise in spite of gravity. As shown in FIG. 3B, the front upper end surface 32*e*2 and the rear upper end surface 32*e*3 of the mass concentrated portion 32*e* pass through the penetrating hole 36, so that the connecting portion 32*d*, the front upper end surface 32*e*2 and the rear upper end surface 32*e*3 become horizontal to collide the rear upper end surface 32*e*3 of the mass concentrated portion 32*e* with the upper limit stopper (action restricting member) 33. As a result, the upper limit of the pivoting of the massive body 32 is restricted. In addition, because the massive body 32 is damped, the player recognizes the feeling of stop with his finger through the key. In the shown example, the front upper end surface 32*e*2 gets into the inside sandwiched between the right and left side walls of the white key main body 1. The free end P of the mass concentrated portion 32*e* is to travel a distance shown as "stroke length" in FIG. 3B.

The auxiliary stopper 34 placed on the undersurface of the front upper mount portion 31*a*1 of the key frame 31*a* is similar to the auxiliary stopper 12 shown in FIG. 1A and FIG. 1B. Each black key main body 2 similarly has a similar massive body pivotably supported by a massive body supporting portion so that the massive body pivots through the force conveying portion of the corresponding black key to collide a similarly shaped mass concentrated portion with the upper limit stopper 33.

In the conventional art, the upper limit stopper 33 is placed on the undersurface of the key frame (equivalent to the front upper mount portion 31*a*1) to be fixed to the undersurface. In the third embodiment, therefore, members for fixing the upper limit stopper 33 are raised from the undersurface of the key frame 31*a* to the undersurface of the forward overhanging portions 31*g*4 by a distance h, so that the position of the front upper mount portion 31*a*1 and the rear upper mount portion 31*a*2 is lowered to reduce the entire height H of the keyboard apparatus.

Even if the height of the front upper end surface 32*e*2 were lowered to have the mass concentrated portion 32*e* in which the front upper end surface 32*e*2 has the same level as the shown rear upper end surface 32*e*3, the entire height H of the keyboard apparatus would be reduced by the distance h. However, the mass concentrated portion 32*e* is designed such that the front upper end surface 32*e*2 is higher than the rear upper end surface (the first contact portion) 32*e*3, resulting in the mass of the mass concentrated portion 32*e* being increased to increase the inertial moment of the massive body 32. More specifically, the mass concentrated portion 32*e* of the third embodiment is designed such that the front upper end surface 32*e*2 is high (long in vertical dimension) enough to get into the inside sandwiched between the right and left side walls of the white key main body 1. Consequently, the free space which is situated inside the right and left side walls of the key is efficiently used to increase the inertial moment of the massive body 32.

d. Fourth Embodiment

Figure 4A:
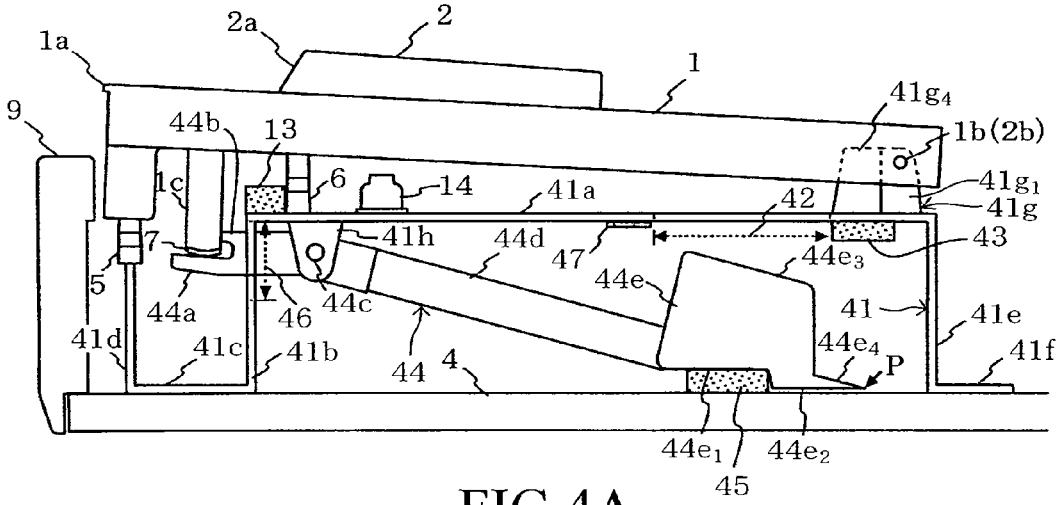
FIG. 4A is a right side view schematically showing a keyboard apparatus of an electronic musical instrument, the keyboard apparatus being a fourth embodiment of the present invention.
Figure 4B:
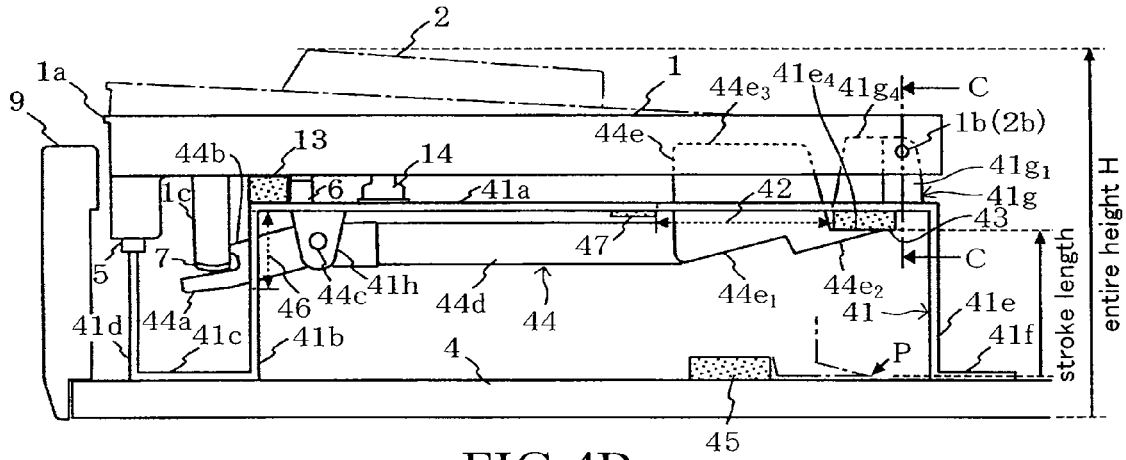
FIG. 4B is a right side view of the keyboard apparatus shown in FIG. 4A, the keyboard apparatus being in a state where a white key has been depressed.
Figure 4C:
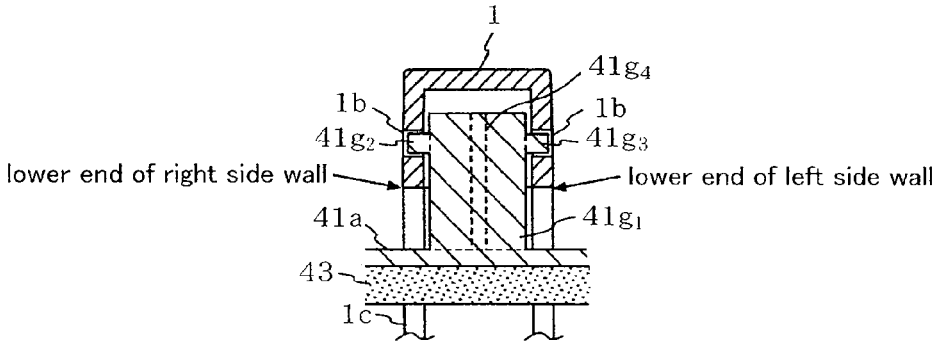
FIG. 4C is a vertical section view showing the white key main body and the black key main body shown in FIG. 4B when viewed along an arrow C-C.

FIG. 4A and FIG. 4B are right side views schematically showing a keyboard apparatus of an electronic musical instrument, the keyboard apparatus being a fourth embodiment of the present invention. FIG. 4A shows a key-release state in which a key has not been depressed. FIG. 4B shows a state in which the white key main body 1 has been depressed. FIG. 4C is a vertical section view schematically showing the white key main body 1 and a key frame 41 when viewed along an arrow C-C in FIG. 4B. In these figures, parts similar to those shown in FIGS. 1A to 1C are given the same numbers to omit detailed explanations.

A general structure of the key frame 41 is similar to that of the key frame 3 shown in FIGS. 1A to 1C. The key frame 41 has an upper mount portion 41*a*, a step portion 41*b*, a base portion 41*c*, a vertical wall 41*d*, a step portion 41*e* and a base 41*f*. On the upper surface in the vicinity of the rear end of the upper mount portion 41*a*, a plurality of supporting portions 41*g* are arranged to protrude upward in parallel to correspond to the plurality of white key main bodies 1 and black key main bodies 2. The plurality of supporting portions 41*g* support their corresponding white key main bodies 1 and the black key main bodies 2 in a freely swingable manner. On the rear part of the upper mount portion 41*a*, in other words, at the front of the supporting portions 41*g*, a plurality of penetrating holes 42 shaped like slits are provided to correspond to the respective keys. As shown in FIG. 4C, the supporting portion 41*g* has an erected portion 41*g*1 and a vertical rib 41*g*4. The vertical rib 41*g*4, which is situated at the midpoint of the key in the direction in which the keys are arranged, is a thin plate extending frontward by a specified distance from the front surface of the erected portion 41*g*1.

The vertical rib 41*g*4 is provided on the upper mount portion 41*a* of the key frame 41. More specifically, the vertical rib 41*g*4 is situated on the upper surface of a part to which a later-described upper limit stopper (upper limit stopper member) 43 is fixed. Therefore, the stiffness of the part increases. In addition, the erected portion 41*g*1 and the vertical rib 41*g*4 are situated in the vicinity of the step portion 41*e*. As a result, when a mass concentrated portion 44*e* of a later-described massive body 44 collides with the upper limit stopper 43, the part to which the upper limit stopper 43 is fixed is less deformed (distorted), resulting in the feeling of stop recognized by the player with his finger being improved.

Inside the right and left side walls of the white key main body 1 or the black key main body 2, there is space situated inside the key, the space being open downward. The upper portion of the above-described erected portion 41*g*1 and the vertical rib 41*g*4 are provided so as to be overlaid with the right and left side walls of the white key main body 1 or the black key main body 2 without interfering with the right and left side walls of the white key main body 1 or the black key main body 2. Therefore, because the vertical rib 41*g*4 is overlaid with the right and left side walls of the white key main body 1 or the black key main body 2, the existence of the vertical rib 41*g*4 will not cause an increase in the entire height H of the apparatus shown in FIG. 4B.

On the upper portion of the right and left side surfaces of the erected portion 41*g*1, axis portions 41*g*2, 41*g*3 are provided. The axis portions 41*g*2, 41*g*3 overhang in the direction in which the keys are arranged. Into the axis portions 41*g*2, 41*g*3, the key fulcrum 1*b* (penetrating hole) provided on the right and left side walls of the rear end of the white key main body 1 is fitted. Supporting portions 41*g* which are not shown and provided for the black key main bodies 2 are configured similarly. Into the axis portions 41*g*2, 41*g*3, more specifically, the key fulcrum 2*b* (penetrating hole) provided on the right and left side walls of the rear end of the black key main body 2 is fitted. Each white key main body 1 or black key main body 2 is supported in a swingable manner in the direction in which the key is depressed and released about the key fulcrum 1*b*, 2*b*.

The plurality of massive bodies 44, a lower limit stopper 45 and the upper limit stopper 43 are situated below (including the space situated inside the respective keys) the plurality of white key main bodies 1 and the plurality of black key main bodies 2 (keyboard surface). A general structure of the massive body 44 is almost the same as that of the massive body 8 shown in FIG. 1A and FIG. 1B. The massive body 44 has a pivot fulcrum 44*c* supported by a massive body supporting portion 41*h*, a main driven portion 44*a* and a secondary driven portion 44*b* which are bifurcated and installed forward of the pivot fulcrum 44*c* to be engaged with the force conveying portion 1*c* of the corresponding key through the elastic member 7, and a mass concentrated portion 44*e* which is situated behind the pivot fulcrum 44*c* with a connecting portion 44*d* sandwiched in between and serves as a free end.

The rear end of the connecting portion 44*d* is connected to the lower portion of the front end of the mass concentrated portion 44*e*. The width of the mass concentrated portion 44*e* along the arranged keys is smaller than the inner width between the right and left side walls of each key. On the step portion 41*b* of the key frame 41, a plurality of penetrating holes 46 shaped like slits are provided so as to correspond to the plurality of keys. The massive body 44 penetrates the penetrating hole 46 between the driven portion 44*a*, 44*b* and the pivot fulcrum 44*c*.

The mass concentrated portion 44*e* has a front lower end surface 44*e*1 and a rear lower end surface 44*e*2. In the key-release state shown in FIG. 4A where the key has been released, the front lower end surface 44*e*1 is located in a position higher than the rear lower end surface 44*e*2. The rear lower end surface 44*e*2 is located close to the key frame bottom board 4 to such an extent as not to come into contact with the key frame bottom board 4. In the shown example, both are kept horizontal. The front lower end surface 44*e*1 serves as a contact part (second contact part) which comes into contact with the lower limit stopper 45 (lower limit stopper member). The lower limit stopper 45 is fastened to the upper surface of the key frame bottom board 4.

On the mass concentrated portion 44*e*, there is a front upper end surface 44*e*3 above the front lower end surface 44*e*1, while there is a rear upper end surface 44*e*4 above the rear lower end surface 44*e*2. In the state shown in FIG. 4B where the key has depressed, the rear upper end surface 44*e*4 serves as a contact part (first contact part) which comes into contact with a later-described upper limit stopper 43. In the shown example, both of the front upper end surface 44*e*3 and the rear upper end surface 44*e*4 are in parallel with the upper mount portion 41*a* of the key frame 41 to be kept horizontal. In this embodiment, the front lower end surface 44*e*1 (second contact part) is located in a position higher than the lowest end (equivalent to the free end P in the shown example) of the rear upper end surface 44*e*4 (first contact part).

In the key-release state shown in FIG. 4A where the key has been released, if the key main body (in the shown example, the white key main body 1) is depressed, the massive body 44 corresponding to the key pivots counterclockwise in spite of gravity. The front upper end surface 44*e*3 of the mass concentrated portion 44*e* passes through the penetrating hole 42 and then gets into the inside sandwiched between the right and left side walls of the white key main body 1 without interfering with the right and left side walls of the white key main body 1. During the move of the mass concentrated portion, a counteraction according to the inertial moment of the massive body 44 is conveyed to the white key main body 1, resulting in a feeling of mass being delivered to a finger of the player. As shown in FIG. 4B, the connecting portion 44*d* of the massive body 44 becomes horizontal to collide the rear upper end surface (the first contact part) 44*e*4 of the mass concentrated portion 44*e* with the upper limit stopper (upper limit stopper member) 43, resulting in restriction on the upper limit of the pivoting massive body 44. Because the restriction on the pivoting of the massive body 44 also involves damping of the massive body 44, the player will recognize a feeling of stop with his finger through the key. The free end P is to travel a distance shown in FIG. 4B as "stroke length". Because the upper limit stopper 43 is fastened to the undersurface of the key frame 41, an impact caused by a collision of the rear upper end surface 44*e*4 of the mass concentrated portion 44*e* with the upper limit stopper 43 will not be conveyed to a finger of the player through the key.

In general, it is known that parts of a pivoting member from a contact part to a pivot fulcrum are not prone to deformation while parts from the contact part to a free end are prone to deformation. In the state shown in FIG. 4B where the key has been depressed, therefore, the rear upper end surface (first contact part) 44*e*4 which comes into contact with the upper limit stopper 43 is positioned in the vicinity of the free end P ("vicinity" can include the free end P and also can exclude the free end P), resulting in a favorable feeling of stop being delivered to the player. In addition, the member of the free end P side can deform, resulting in reduced possibility that the rear upper end surface 44*e*4 collide with an unexpected part other than the upper limit stopper 43 such as the upper mount portion 41*a* of the key frame 41 and the white key main body 1.

On the undersurface of the upper mount portion 41*a* of the key frame 41, an auxiliary stopper 47 is provided so as to adjoin to the front end of the penetrating hole 42 in the shown example. If a depression of the key causes the massive body 44 to transiently exceed (over-stroke) the upper limit position (fully depressed standstill position) of the pivoting of the massive body 44, the auxiliary stopper 47 prevents collision of the connecting portion 44*d* with the upper mount portion 41*a* of the key frame 41. In a case where there is no possibility of such collision, however, the auxiliary stopper 47 is not necessary.

If the player releases the key, the massive body 44 pivots in a reverse direction because of its self weight to return to the position shown in FIG. 4A. As a result, the front lower end surface 44*e*1 of the mass concentrated portion 44*e* collides with the lower limit stopper 45, resulting in the initial position of the massive body 44 (key-release state) being defined. Because collision of the mass concentrated portion 44*e* with the lower limit stopper 45 is caused only by gravity without any key-depression force, an impact brought about by the collision is small. Therefore, although the front lower end surface (second contact part) 44*e*1 which comes into contact with the lower limit stopper 45 has a shorter distance to the pivot fulcrum 44*c* than the rear upper end surface (first contact part) 44*e*4, deformation of the massive body 44 will not present any problem. Because the lower end surface 44*e*1 of the mass concentrated portion 44*e* in which the mass of the massive body 44 concentrates has the contact part (second contact part) which comes into contact with the lower limit stopper 45, deterioration in the feeling of stop such as rebound and vibration at the time of key-release can be reduced.

When the white key main body 1 or the black key main body 2 is depressed, on the other hand, the lower limit stopper 43 provided on the upper surface of the front part of the upper mount portion 41*a* of the key frame 41 restricts lower limit of the lower end of the right and left side walls of the depressed key. Because the above-described upper limit stopper 43 is fixed to the upper mount portion 41*a* of the key frame 41, by arranging the upper limit stopper 43 like a ribbon along the arranged keys like the lower limit stopper 45, the auxiliary stopper 47 and the lower limit stopper 13, the upper limit stopper 43 can be shared by the plurality of massive bodies 44 of at least two corresponding keys. More specifically, the upper limit stopper 43 can be shared by the plurality of massive bodies 44 of all the keys or by the plurality of massive bodies 44 of keys included in an octave or a few octaves. Compared with a case where the upper limit stopper 43 is provided for each massive body 44 to be fixed separately, the fourth embodiment in which the upper limit stopper 43 is shared by the plurality of massive bodies improves the efficiency of assembly of the keyboard apparatus.

In this embodiment, in the key-release state shown in FIG. 4A where the key has been released, the front lower end surface 44*e*1 (second contact part) is located in a position higher than the lowest end of the rear upper end surface (first contact part) 44*e*4. As a result, the mass concentrated portion 44*e* is partly overlaid with the lower limit stopper 45 in the height direction. In the conventional massive body as described in Japanese Unexamined Patent Publication NO. H4-142595, however, a flat lower end surface comes into contact with a lower limit stopper. As a result, the lower end surface (second contact part) is located in a high position according to the thickness of the lower limit stopper, resulting in the entire height of the keyboard apparatus being raised. In this embodiment, however, the height of the upper mount portion 41*a* of the key frame 41 is lower than that of the conventional art because of the overlaying of the mass concentrated portion 44*e* with the lower limit stopper 45, resulting in the entire height H of the keyboard apparatus being lowered.

In the state shown in FIG. 4B where the key has been depressed, furthermore, the front upper end surface 44*e*3 is located in a position higher than the rear upper end surface (first contact part) 44*e*4. This structure contributes increase in the mass of the mass concentrated portion 44*e*. The mass concentrated portion 44*e* is designed such that the upper part (the front upper end surface 44*e*3) of the mass concentrated portion 44*e* is located in the unused space which is located inside the right and left side walls of the key when the key has been depressed. More specifically, the massive body 44 is overlaid with the key in the height direction without interfering with the right and left side walls of the key, resulting in the entire height H of the keyboard apparatus being unchanged. The mass concentrated portion 44*e* may be designed such that the front upper end surface 44*e*3 is overlaid with only the upper limit stopper 43 in a state where the key has been fully depressed. Alternatively, the mass concentrated portion 44*e* may be designed such that the front upper end surface 44*e*3 is located between the upper surface of the upper mount portion 41*a* and the lower end of the right and left side walls of the key in the state where the key has been fully depressed.

e. Fifth Embodiment

Figure 5A:
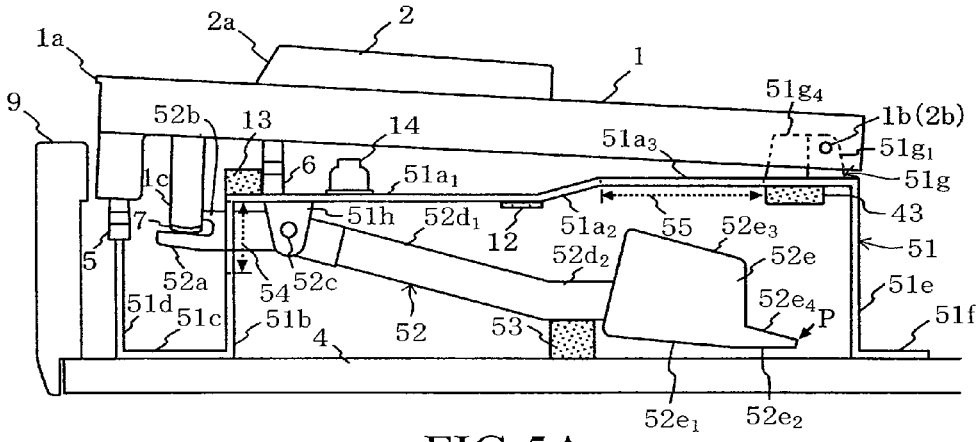
FIG. 5A is a right side view schematically showing a keyboard apparatus of an electronic musical instrument, the keyboard apparatus being a fifth embodiment of the present invention.
Figure 5B:
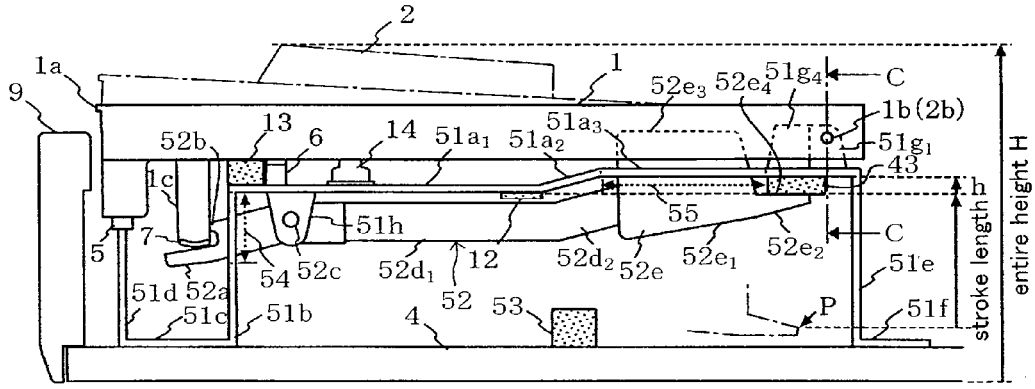
FIG. 5B is a right side view of the keyboard apparatus shown in FIG. 5A, the keyboard apparatus being in a state where a white key has been depressed.
Figure 5C:
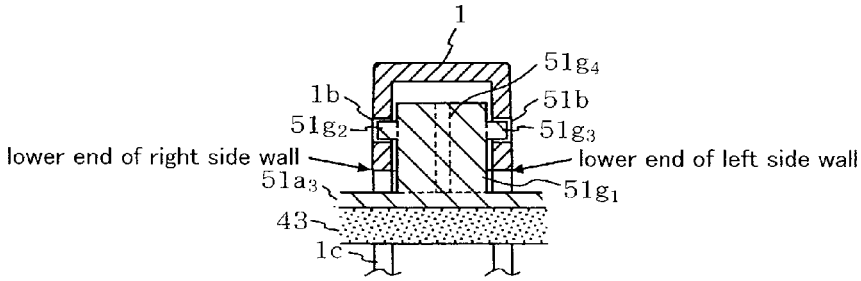
FIG. 5C is a vertical section view showing the white key main body and the black key main body shown in FIG. 5B when viewed along an arrow C-C.

FIG. 5A and FIG. 5B are right side views schematically showing a keyboard apparatus of an electronic musical instrument, the keyboard apparatus being a fifth embodiment of the present invention. FIG. 5A shows a key-release state in which a key has not been depressed. FIG. 5B shows a state in which the white key main body 1 has been fully depressed. FIG. 5C is a vertical section view schematically showing the white key main body 1, a key frame 51 and an upper limit stopper 53 when viewed along an arrow C-C in FIG. 5B. In these figures, parts similar to those shown in FIGS. 4A to 4C are given the same numbers to omit detailed explanations. In comparison to the embodiment shown in FIGS. 4A to 4C, the fifth embodiment is designed such that a part which comes into contact with the lower limit stopper is provided on the undersurface of a connecting portion while the position of the upper limit stopper is raised by raising the rear part of the upper mount portion of the key frame.

A general structure of the key frame 51 is similar to that of the key frame 41 shown in FIG. 4A and FIG. 4B. However, an upper mount portion 51*a* included in the key frame 51 is separated into the front and the rear. A front upper mount portion 51*a*1 is connected to a rear upper mount portion 51*a*3 which is slightly higher than the front upper mount portion 51*a*1 with a transition portion 51*a*2 interposed in between. The key frame 51 has a step portion 51*b*, a base 51*c*, a vertical wall 51*d*, a step portion 51*e* and a base 51*f*. On the step portion 51*b*, a plurality of penetrating holes 54 shaped like slits are arranged to correspond to the plurality of keys. In the vicinity of the rear end of the rear upper mount portion 51*a*3, a plurality of supporting portions 51*g* are arranged in parallel to correspond to the plurality of white key main bodies 1 and black key main bodies 2. Each supporting portion 51*g* has an erected portion 51*g*1 and a vertical rib 51*g*4. On the rear part of the rear upper mount portion 51*a*3, a plurality of penetrating holes 55 shaped like slits are provided in front of the supporting portions 51*g* to correspond to the respective keys.

As shown in FIG. 5C, on the upper part of the right and left side surfaces of the erected portion 51*g*1, axis portions 51*g*2, 51*g*3 are provided. The height of the shown axis portions 51*g*2, 51*g*3 is the same as that of the axis portions 41*g*2, 41*g*3 shown in FIG. 4C. The upper part of the supporting portion 51*g* is located inside the right and left side walls of the white key main body 1 or the black key main body 2. Massive bodies 52 are arranged below (including the space situated inside the respective keys) the plurality of white key main bodies 1 and the plurality of black key main bodies 2 (keyboard surface) so as to correspond to the keys, respectively. A general structure of the massive body 52 is almost the same as that of the massive body 44 shown in FIGS. 4A to 4C. The massive body 52 is supported by a massive body supporting portion 51*h* to pivot through the force conveying portion 1*c* of the corresponding key.

The massive body 52 has a main driven portion 52*a*, a secondary driven portion 52*b* and a pivot fulcrum 52*c*. A connecting portion 52*d* has a structure in which a front connecting portion 52*d*1 is connected to a rear connecting portion 52*d*2. When the key has been released as shown in FIG. 5A, the rear connecting portion 52*d*2 comes into contact with the lower limit stopper 53. At the time of contact, in the shown example, the lower end surface (second contact part) of the rear connecting portion 52*d*2 becomes horizontal to be parallel to the key frame bottom board 4. The rear end of the rear connecting portion 52*d*2 is connected to the lower part of the front end of a mass concentrated portion 52*e*.

The mass concentrated portion 52*e* has a front lower end surface 52*e*1 and a rear lower end surface 52*e*2. In the key-release state shown in FIG. 5A, in the shown example, the front lower end surface 52*e*1, which is an inclined surface where the rear is lowered, is connected to the rear lower end surface 52*e*2 which is horizontal. In this key-release state, the lower end surface (second contact part) of the rear connecting portion 52*d*2 is located in a position higher than the lowest end of a later-described rear upper end surface 52*e*4 (first contact part). The rear lower end surface 52*e*2 is located close to the key frame bottom board 4 to such an extent as not to come into contact with the key frame bottom board 4. The rear connecting portion (second contact part) 52*d*2 serves as a contact part which comes into contact with the lower limit stopper 53. The lower limit stopper 53 is fastened to the upper surface of the key frame bottom board 4.

The mass concentrated portion 52*e* has a front upper end surface 52*e*3 situated above the front lower end surface 52*e*1. The mass concentrated portion 52*e* also has a rear upper end surface (first contact part) 52*e*4 situated above the rear lower end surface 52*e*2. In the shown example, the front upper end surface 52*e*3 and the rear upper end surface 52*e*4 become parallel with the rear upper mount portion 51*a*3 of the key frame 51 to be horizontal in the state shown in FIG. 5B where the key has been depressed. The rear upper end surface 52*e*4 serves as a contact part (first contact part) which comes into contact with the upper limit stopper 43.

In the key-release state shown in FIG. 5A, if the white key main body 1 is depressed, the massive body 52 provided for the key pivots counterclockwise in spite of gravity. Because this embodiment is designed such that the rear upper end surface 52*e*4 is lowered, the position of the front upper end surface 52*e*3 is higher than the upper limit stopper 43 when the key has been fully depressed as shown in FIG. 5B. In the shown example, the massive body 52 pivots so that the front upper end surface 52*e*3 passes through the penetrating hole 55 with the front connecting portion 52*d*1 becoming horizontal and that the front upper end surface 52*e*3 gets into the inside sandwiched between the right and left side walls of the white key main body 1, with the rear upper end surface 52*e*4 colliding with the upper limit stopper (action restricting member) 43. The free end P travels a distance shown in FIG. 5B as "stroke length". Each black key main body 2 also has a similar massive body which pivots by a force conveying portion of the corresponding key to collide with the upper limit stopper 43.

In the shown example, the entire height H of the keyboard apparatus is the same as that of the embodiment shown in FIG. 4A to FIG. 4C. However, because the rear upper mount portion 51*a*3 is higher than the front upper mount portion 51*a*1 (by a distance h), the position of the upper limit stopper 43 displaces upward by the distance h. As a result, it is possible to make the height of the rear upper end surface 52*e*4 in the key-release state shown in FIG. 5A higher than that of the rear upper end surface 44*e*4 shown in FIGS. 4A to 4C. Consequently, the vertical thickness (in the height direction) between the rear lower end surface 52*e*2 and the rear upper end surface 52*e*4 can be increased, which results in increase in strength of the parts. Alternatively, in a case where the vertical thickness between the rear lower end surface 52*e*2 and the rear upper end surface 52*e*4 is made as thin as that shown in FIGS. 4A to 4C, the entire height H of the keyboard apparatus can be made lower than that of the embodiment shown in FIG. 1.

f. Sixth Embodiment

Figure 6A:
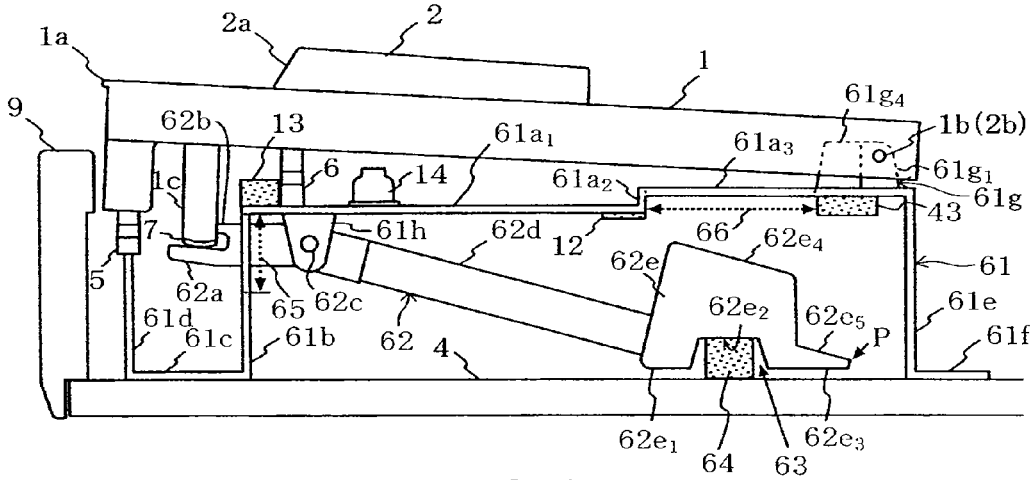
FIG. 6A is a right side view schematically showing a keyboard apparatus of an electronic musical instrument, the keyboard apparatus being a sixth embodiment of the present invention.
Figure 6B:
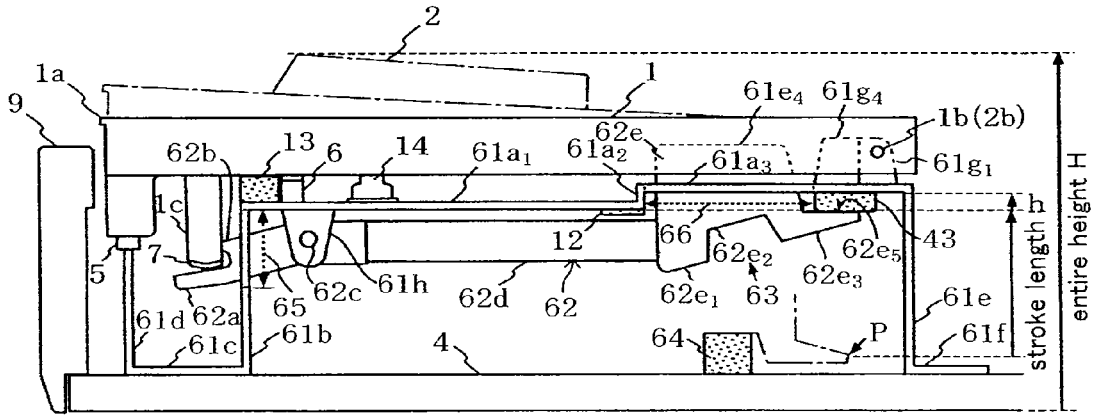
FIG. 6B is a right side view of the keyboard apparatus shown in FIG. 6A, the keyboard apparatus being in a state where a white key has been depressed.

FIG. 6A and FIG. 6B are right side views schematically showing a keyboard apparatus of an electronic musical instrument, the keyboard apparatus being a sixth embodiment of the present invention. FIG. 6A shows a key-release state in which a key has not been depressed. FIG. 6B shows a state in which the white key main body has been depressed. The vertical section view of the white key main body 1 and a key frame 61 is omitted, for the vertical section view would be the same as that of the white key main body 1 and the key frame 51 shown in FIG. 5C. In these figures, parts similar to those shown in FIGS. 4A to 4C are given the same numbers to omit detailed explanations.

This embodiment is designed such that a mass concentrated portion 62 has a part which comes into contact with a lower limit stopper 64. A general structure of the key frame 61 is similar to that of the key frames 41, 51 shown in FIGS. 4A to 4C, and 5A to 5C. A front upper mount portion 61*a*1 is connected to a rear upper mount portion 61*a*3 which is higher than the front upper mount portion 61*a*1 through a step portion 61*a*2. The step is designed to correspond with the shape of connection between a later-described connecting portion 62*d* and mass concentrated portion 62*e* of a massive body.

The key frame 61 has a step portion 61*b*, a base 61*c*, a vertical wall 61*d*, a step portion 61*e* and a base 61*f*. On the step portion 61*b* of the key frame 61, a plurality of penetrating holes 65 shaped like slits are arranged to correspond to the plurality of keys. In the vicinity of the rear end of the rear upper mount portion 61*a*3, a plurality of supporting portions 61*g* are arranged in parallel to correspond to the plurality of keys. Each supporting portion 61*g* has an erected portion 61*g*1 and a vertical rib 61*g*4. On the rear upper mount portion 61*a*3 of the key frame 61, a plurality of penetrating holes 66 shaped like slits are provided to correspond to the respective keys.

Massive bodies 62 are arranged below (including space inside the respective keys) the plurality of white key main bodies 1 and the plurality of black key main bodies 2 (keyboard surface) to correspond to the respective white key main bodies 1 and the black key main bodies 2. A general structure of the massive bodies 62 is almost the same as that of the massive bodies 44, 52 shown in FIGS. 4A to 4C and FIGS. 5A to 5C. Each massive body 62 is supported by a massive body supporting portion 61*h* to pivot through the force conveying portion 1*c* of a corresponding key. Each massive body 62 has a main driven portion 62*a*, a secondary driven portion 62*b*, a pivot fulcrum 62*c*, a connecting portion 62*d* and a mass concentrated portion 62*e*. The rear end of the connecting portion 62*d* is perpendicularly connected to the lower part of the front end of the mass concentrated portion 62*e*. The mass concentrated portion 62*e* has a concave portion 63 provided between a front lower end surface 62*e*1 and a rear lower end surface 62*e*3. The concave portion 63 is open downward. In the shown example, both the front lower end surface 62*e*1 and the rear lower end surface 62*e*3 are away from the key frame bottom board 4 by the same distance, being in a horizontal position. In the key-release state, the upper part of a lower limit stopper 64 is situated inside the concave portion 63 to be in contact with a ceiling surface (second contact part) 62*e*2 of the concave portion 63. Because the concave portion 63 is overlaid with the massive body 62 (mass concentrated portion 62*e*) when viewed in the height direction, the entire height H of the keyboard apparatus will not be raised.

Similarly to the mass concentrated portion 44*e* shown in FIG. 4A to FIG. 4C, because the mass concentrated portion 62*e* in which the mass of the massive body 62 concentrates has a contact part (the second contact part, that is, the ceiling surface 62*e*2 of the concave portion 63) which comes into contact with the lower limit stopper 64, deterioration in the feeling of stop such as rebound and vibration at the time of key-release can be reduced. In the case of the mass concentrated portion 44*e* shown in FIGS. 4A to 4C, however, there is a clearance on the left side (frontward in the longitudinal direction of a key) of the lower limit stopper 45, the clearance being positioned between the lower end surface 44*e*1 and the key frame bottom board 4. In the case of the mass concentrated portion 62*e*, the first lower end surface 62*e*1 is placed close to the bottom board 4 of the key frame to fill in the clearance. As a result, it is possible to increase the mass of the mass concentrated portion 62*e*, also increasing the inertial moment of the massive body 62.

The mass concentrated portion 62*e* has a front upper end surface 62*e*4 which is situated above a part extending from the front lower end surface 62*e*1 to the front part of the rear lower end surface 62*e*3 through the ceiling surface 62*e*2 (second contact part). The mass concentrated portion 62*e* also has a rear upper end surface 62*e*5 which is situated above a rear part of the rear lower end surface 62*e*3. In this embodiment, in the key-release state shown in FIG. 6A, the ceiling surface (second contact part) 62*e*2 is located in a position higher than the lowest end of the rear upper end surface (first contact part) 62*e*5. In the shown example, the front upper end surface 62*e*4 and the rear upper end surface 62*e*5 become horizontal to be in parallel with the rear upper mount portion 61*a*3 of the key frame in a state shown in FIG. 6B where the key has been depressed. The rear upper end surface 62*e*5 serves as a contact part (first contact part) which comes into contact with the upper limit stopper 61.

In the key-release state shown in FIG. 6A, when the white key main body 1 is depressed, the massive body 62 corresponding to the key pivots counterclockwise in spite of gravity. In the shown example, the massive body 62 pivots so that the front upper end surface 62*e*4 passes through the penetrating hole 66 with the connecting portion 62*d* becoming horizontal and that the front upper end surface 62*e*4 gets into the inside sandwiched between the right and left side walls of the white key main body 1, with the rear upper end surface 62*e*5 colliding with the upper limit stopper (action restricting member) 43. The free end P travels a distance shown in FIG. 6B as "stroke length". Each black key main body 2 also has a similar massive body which pivots by a force conveying portion of the corresponding key to collide with the upper limit stopper 43.

In the shown example, the height of the front upper mount portion 61*a*1 and the entire height H of the keyboard apparatus are the same as those of the embodiment shown in FIGS. 4A to 4C. Similarly to the embodiment shown in FIGS. 5A to 5C, however, the position of the upper limit stopper 43 displaces upward by the distance h. As a result, the vertical thickness (in the height direction) between the rear lower end surface 62*e*3 and the rear upper end surface 62*e*5 can be increased. Alternatively, in a case where the vertical thickness between the rear lower end surface 62*e*3 and the rear upper end surface 62*e*5 is made as thin as that shown in FIGS. 4A to 4C, the entire height H of the keyboard apparatus can be made lower than that of the embodiment shown in FIGS. 4A to 4C.

g. Other Modified Examples

In the above-described respective embodiments, the plurality of massive bodies 8, 22, 32, 44, 52, 62, the lower limit stoppers 10, 45, 53, 64 and the upper limit stoppers 11, 23, 33, 43 are placed below (including the space inside the respective keys) the plurality of white key main bodies 1 and the plurality of black key main bodies 2 (keyboard surface). More specifically, being placed below the white key main bodies 1 and the black key main bodies 2 indicates that, when viewed in the height direction of the apparatus, the height of the respective positions where the plurality of massive bodies, the lower limit stoppers and the upper limit stoppers are placed are lower than the height of the plurality of white key main bodies 1 and the plurality of black key main bodies 2 (keyboard surface). In the respective embodiments, the plurality of massive bodies, the lower limit stoppers and the upper limit stoppers completely fit, in the longitudinal direction of the respective keys, into a section ranging from the tip 1*a* of the respective white key main bodies to the rear end of the respective white key main bodies 1 and the respective black key main bodies 2. However, at least any one item of the plurality of massive bodies, the lower limit stoppers and the upper limit stoppers may extend off the section. For instance, at least one item may protrude backward from the rear end of the respective white key main bodies 1 and the respective black key main bodies 2. As long as the protrusion is slight, the protrusion will have little effect on the depth of the electronic keyboard instrument equipped with other components in addition to the keyboard apparatus.

In the above-described respective embodiments, the massive bodies 8, 22, 32, 44, 52, 62 are designed to have the mass concentrated portions 8*e*, 22*e*, 32*e*, 44*e*, 52*e*, 62*e* situated on their free end side. However, as long as the respective massive bodies pivot in synchronization with key-depression of the respective keys, the respective embodiments may be modified to have a structure in which it is not clear that the mass is concentrated.

In the above-described respective embodiments, the massive body supporting portions 3*h*, 21*h*, 31*h*, 41*h*, 51*h*, 61*h* are erected on the undersurface of the upper mount portion 3*a*, 21*a*, 31*a*1 (front upper mount portion), 41*a*, 51*a*1 (front upper mount portion), 61*a*1 (front upper mount portion) of the respective key frames 3, 21, 31, 41, 51. However, the respective massive body supporting portions may be erected on the upper surface of the key frame bottom board 4. Alternatively, the key frames 3, 21, 31, 41, 51, 61 may have a front lower mount portion so that the massive body supporting portions are erected on the upper surface of the front lower mount portion. In these cases, the frames are designed such that any part of the key frames 3, 21, 31, 41, 51, 61 is not located on an area where the driven side of the massive bodies 8, 22, 32, 44, 52, 62 passes through (equivalent to the area of the penetrating holes 15, 25, 35, 46, 54, 65) and on an area where the mass concentrated portion 8*e*, 22*e*,32*e*, 44*e*, 52*e*, 62*e* passes through (equivalent to the area of the penetrating holes 16, 36, 42, 55, 66) during pivoting of the massive bodies 8, 22, 32, 44, 52, 62.

What is claimed is:

1. A keyboard apparatus of an electronic musical instrument, the keyboard apparatus comprising:

a plurality of keys;

a plurality of massive bodies situated below the plurality of keys in a one-to-one correspondence with the keys, each massive body pivoting in synchronization with key-depression of its corresponding key;

a frame on which the plurality of keys and the plurality of massive bodies are arranged in parallel;

an upper limit stopper member which is placed below the plurality of keys to be fixed to the frame side such that a collision of each massive body with the upper limit stopper member results in restriction on upper limit of pivoting range of the each massive body;

a lower limit stopper member which is placed below the plurality of keys to be fixed to the frame side such that a collision of each massive body with the lower limit stopper member results in restriction on lower limit of pivoting range of the each massive body; and a plurality of fixing portions provided on the frame in a one-to-one correspondence with the plurality of keys, at least an upper part of each fixing portion being situated inside right and left side walls of its corresponding key, each fixing portion having an undersurface to which the upper limit stopper member is fixed.

2. A keyboard apparatus of an electronic musical instrument according to claim 1, wherein the plurality of fixing portions protrude upward from an upper surface of the frame; the frame has a plurality of penetrating holes through which the plurality of massive bodies pass; and the each massive body is situated below the frame in a state where a key corresponding to the each massive body has been released, while the each massive body is displaced upward to be situated above the frame through the penetrating hole corresponding to the each massive body when the key corresponding to the each massive body is depressed.

3. A keyboard apparatus of an electronic musical instrument according to claim 2, wherein each of the plurality of fixing portions is formed of an erected portion being erected upward from the upper surface of the frame and a forward overhanging portion overhanging forward from an upper portion of the erected portion; and the upper limit stopper member is fixed to an undersurface of the forward overhanging portion of each fixing portion.

4. A keyboard apparatus of an electronic musical instrument according to claim 3, wherein the undersurface of the forward overhanging portion is situated below lower end surface of right and left side walls of its corresponding key even in a state where the corresponding key has been depressed.

5. A keyboard apparatus of an electronic musical instrument according to claim 4, wherein the upper limit stopper member is shaped like a ribbon whose longitudinal direction coincides with a direction in which the plurality of keys are arranged, and continuously extends over at least two neighboring keys to be fixed to the undersurface of the respective forward overhanging portions provided for the at least two keys.

6. A keyboard apparatus of an electronic musical instrument according to claim 3, wherein a vertical rib is provided on an upper surface of the forward overhanging portion.

7. A keyboard apparatus of an electronic musical instrument according to claim 2, wherein the frame has a step which extends in the direction in which the plurality of keys are arranged and is situated midway between a front and a rear of the frame so that the height of the rear is lower than that of the front; and the plurality of fixing portions are provided on an upper surface of the rear.

8. A keyboard apparatus of an electronic musical instrument according to claim 2, wherein the each massive body has a mass concentrated portion situated at a rear end of the each massive body; and the mass concentrated portion has a step situated on an upper surface of the mass concentrated portion so that a vertical thickness of a part which comes into contact with the upper limit stopper member at the time of key-depression of the corresponding key is smaller than that of other parts of the mass concentrated portion.

9. A keyboard apparatus of an electronic musical instrument according to claim 2, wherein the plurality of fixing portions pivotably support the plurality of keys, respectively.

10. A keyboard apparatus of an electronic musical instrument according to claim 1, wherein each of the plurality of fixing portions has a vertical rib situated on an upper surface side of the each fixing portion.

11. A keyboard apparatus of an electronic musical instrument according to claim 1, wherein the undersurface of the each fixing portion is situated below lower end surface of right and left side walls of its corresponding key even in a state where the corresponding key has been depressed.

12. A keyboard apparatus of an electronic musical instrument according to claim 11, wherein the upper limit stopper member is shaped like a ribbon whose longitudinal direction coincides with a direction in which the plurality of keys are arranged, and continuously extends over at least two neighboring keys to be fixed to the undersurface of the respective fixing portions provided for the at least two keys.

13. A keyboard apparatus of an electronic musical instrument according to claim 1, wherein the plurality of fixing portions are part of the frame;

the upper limit stopper member is fixed to the undersurface of the respective fixing portions; and the each massive body is situated below the frame even in a state where a key corresponding to the each massive body has been depressed.

14. A keyboard apparatus of an electronic musical instrument, the keyboard apparatus comprising:

a plurality of keys;

a plurality of massive bodies situated below the plurality of keys in a one-to-one correspondence with the keys, each massive body pivoting in synchronization with key-depression of its corresponding key;

a frame on which the plurality of keys and the plurality of massive bodies are arranged in parallel;

an upper limit stopper member which is placed below the plurality of keys to be fixed to the frame side such that a collision of each massive body with the upper limit stopper member results in restriction on upper limit of pivoting range of the each massive body; and a lower limit stopper member which is placed below the plurality of keys to be fixed to the frame side such that a collision of each massive body with the lower limit stopper member results in restriction on lower limit of pivoting range of the each massive body;

the each massive body having a first contact portion on a downwardly offset protruding step which comes into contact with the upper limit stopper member in a state where a key corresponding to the each massive body has been depressed and a second contact portion within an upwardly offset portion of the each massive body which comes into contact with the lower limit stopper member in a state where the corresponding key has been released; and the first contact portion being situated close to a free end of the each massive body with the second contact portion being situated closer to a pivot fulcrum side of the each massive body than the first contact portion, the second contact portion being situated in a position higher than the lowest end of the first contact portion in a state where the key corresponding to the each massive body has been released by virtue of the upwardly offset portion being higher than the protruding step.

15. A keyboard apparatus of an electronic musical instrument according to claim 14, wherein the plurality of keys are pivotably supported by a plurality of supporting portions provided on an upper surface of the frame, respectively;

the upper limit stopper member is fixed to an undersurface of the frame;

the frame has a plurality of penetrating holes through which the plurality of massive bodies pass; and the each massive body is situated below the frame in a state where a key corresponding to the each massive body has been released, while the each massive body is displaced upward to be situated above the frame through the penetrating hole corresponding to the each massive body when the key corresponding to the each massive body is depressed.

16. A keyboard apparatus of an electronic musical instrument according to claim 15, wherein the upper limit stopper member is shaped like a ribbon whose longitudinal direction coincides with a direction in which the plurality of keys are arranged, and continuously extends over at least two neighboring keys to be fixed to the undersurface of the respective fixing portions provided for the at least two keys.

17. A keyboard apparatus of an electronic musical instrument according to claim 15, wherein the each massive body is designed such that an upper portion of the each massive body is situated inside right and left side walls of the key corresponding to the each massive body in a state where the corresponding key has been depressed.

18. A keyboard apparatus of an electronic musical instrument according to claim 14, wherein on the upper surface of the frame, a plurality of vertical ribs are provided, the plurality of vertical ribs being situated on a plurality of positions with which the plurality of massive bodies come into contact, respectively.

19. A keyboard apparatus of an electronic musical instrument according to claim 15, wherein on the upper surface of the frame, a plurality of vertical ribs are provided, the plurality of vertical ribs being situated on a plurality of positions with which the plurality of massive bodies come into contact, respectively; and each of the vertical ribs is formed integrally with the each supporting portion.

20. A keyboard apparatus of an electronic musical instrument according to claim 14, wherein the each massive body has a concave portion which is open downward such that a ceiling surface of the concave portion serves as the second contact portion to come into contact with the lower limit stopper member in a state where the corresponding key has been released.

* * * * *